US005821951A

United States Patent [19]

Fujii et al.

[11] Patent Number: 5,821,951

[45] **Date of Patent: *Oct. 13, 1998**

[54] INK JET PRINTER HAVING AN ELECTROSTATIC ACTIVATOR AND ITS CONTROL METHOD

[75] Inventors: Masahiro Fujii; Ikuhiro Miyashita; Shigeo Sugimura; Hiroshi Koeda; Naoki Kobayashi; Asahiro Oguchi, all of Suwa, Japan

[73] Assignee: Seiko Epson Corporation, Tokyo, Japan

[ * ] Notice: The term of this patent shall not extend beyond the expiration date of Pat. No. 5,668,579.

[21] Appl. No.: 840,829

[22] Filed: Apr. 16, 1997

Related U.S. Application Data

[63] Continuation of Ser. No. 259,656, Jun. 14, 1994, Pat. No. 5,668,579.

[30] Foreign Application Priority Data

Jun. 16, 1993 [JP] Japan ..... 5-145212
Jun. 16, 1993 [JP] Japan ..... 5-145213

[51] Int. Cl.[6] ..... B41J 29/38; B41J 2/04; B41J 2/095

[52] U.S. Cl. ..... 347/10; 347/54

[58] Field of Search ..... 347/10, 54, 11, 347/48, 9; B41J 29/38

[56] References Cited

U.S. PATENT DOCUMENTS

| | | | |
|---|---|---|---|
| 3,440,873 | 4/1969 | Eichelberger | 73/141 |
| 3,614,678 | 10/1971 | Engler | 333/187 |
| 3,634,727 | 1/1972 | Polye | 361/434 |
| 3,918,019 | 11/1975 | Nunn | 338/42 |
| 3,938,175 | 2/1976 | Jaffe et al. | 338/4 |
| 3,949,246 | 4/1976 | Lohrmann | 310/332 |
| 3,952,234 | 4/1976 | Birchall | 361/283.4 |
| 4,180,225 | 12/1979 | Yamada | 347/76 |
| 4,203,128 | 5/1980 | Guckel et al. | 331/156 |
| 4,275,402 | 6/1981 | Kern | 347/14 |
| 4,282,535 | 8/1981 | Kern et al. | 347/10 |
| 4,312,008 | 1/1982 | Taub et al. | 347/71 |
| 4,354,197 | 10/1982 | Reitberger | 347/55 |
| 4,398,204 | 8/1983 | Dietrich et al. | 347/68 |
| 4,459,601 | 7/1984 | Howkins | 347/68 |
| 4,471,363 | 9/1984 | Hanoaka | 347/10 |
| 4,509,059 | 4/1985 | Howkins | 347/10 |
| 4,520,375 | 5/1985 | Kroll | 347/54 |
| 4,604,633 | 8/1986 | Kimura et al. | 347/7 |
| 4,744,863 | 5/1988 | Guckel et al. | 438/53 |
| 4,814,845 | 3/1989 | Kurtz | 73/724 |
| 4,853,669 | 8/1989 | Guckel et al. | 338/4 |
| 4,996,082 | 2/1991 | Guckel et al. | 427/99 |
| 5,022,745 | 6/1991 | Zayhowski et al. | 359/847 |
| 5,075,250 | 12/1991 | Hawkins et al. | 438/21 |
| 5,189,777 | 3/1993 | Guckel et al. | 29/424 |
| 5,513,431 | 5/1996 | Ohno et al. | 347/54 |
| 5,534,900 | 7/1996 | Ohno et al. | 347/54 |
| 5,563,634 | 10/1996 | Fujii et al. | 347/54 |
| 5,644,341 | 7/1997 | Fujii et al. | 347/11 |
| 5,668,579 | 9/1997 | Fujii et al. | 347/54 |

FOREIGN PATENT DOCUMENTS

| | | |
|---|---|---|
| 0 479 441 | 4/1992 | European Pat. Off. . |
| 263776 | 11/1986 | Japan . |
| 59911 | 12/1986 | Japan . |
| 24218 | 5/1990 | Japan . |
| 289351 | 11/1990 | Japan . |
| 51734 | 11/1990 | Japan . |

*Primary Examiner*—N. Le
*Assistant Examiner*—L. Anderson
*Attorney, Agent, or Firm*—Eric B. Janofsky

[57] ABSTRACT

An ink jet printer provided with an ink jet print head having a nozzle, an ink channel that is connected to the nozzle, and an electrostatic actuator that is composed of a diaphragm that is provided in a part of the ink channel and an electrode placed outside of the ink channel opposite to the diaphragm. The diaphragm is distorted by means of an electrostatic force generated by applying voltage to the electrostatic actuator thereby performing printing with ink droplets ejected from the nozzle. The electrostatic actuator driver comprises a timing pulse generator, charge circuit and discharge circuit. The driver controls an amount of charge to be charged to the electrostatic actuator as well as charge rate thereof corresponding to the environmental operating condition of the ink jet printer.

49 Claims, 38 Drawing Sheets

T
111

112

INK JET PRINTER HAVING AN ELECTROSTATIC ACTIVATOR AND ITS CONTROL METHOD

This is a Continuation of prior application Ser. No. 08/259,656, filed on Jun. 14, 1994, now U.S. Pat. No. 5,668,579.

CROSS-REFERENCE TO RELATED APPLICATION

This application is related to the following commonly-assigned, co-pending patent application:

"Ink-Jet Head Driving Method and Driving Device and Printer Using The Same", Ser. No. 08/274,184, filed Jul. 12, 1994, now U.S. Pat. No. 5,563,634.

BACKGROUND OF THE INVENTION

1. Field of the Invention

This invention relates generally to an apparatus for and method of driving a nonimpact type printer. More particularly, the present invention is directed to an apparatus for and method of driving a demand type ink jet head having an electrostatic actuator.

2. Description of the Related Art

Ink jet recording apparatuses offer numerous benefits, including extremely quiet operation when recording, high speed printing, a high degree of freedom in ink selection, and the ability to use low-cost plain paper. The so-called "ink-on-demand" drive method whereby ink is output only when required for recording is now the mainstream in such recording apparatuses because it is not necessary to recover ink not needed for recording.

The ink jet heads used in this ink-on-demand method commonly use a piezoelectric device for the drive means as described in JP-B-1990-51734, or ejection of the ink by means of pressure generated by heating the ink to generate bubbles as described in JP-B-1986-59911.

The following problems, however, are presented by these conventional ink jet heads.

In the former method using a piezoelectric device, the process of bonding the piezoelectric chip to the diaphragms used to produce pressure in the pressure chamber is complex. With current ink jet recording apparatuses having plural nozzles and a high nozzle density to meet the demand for high speed, high quality printing, these piezoelectric devices must be precisely manufactured and bonded to the diaphragms, processes that are extremely complicated and time-consuming. As the nozzle density has increased, it has become necessary to process the piezoelectric devices having a width in the order of magnitude of several ten to hundred microns. With the dimensional and shape precision achievable using current machining processes, however, it is difficult to manufacture with precision such devices. Accordingly, there is a wide variation in print quality.

In the latter method whereby the ink is heated, the drive means is a thin-film resistive heater that generally eliminates the above problems. However, this type of device has other problems. For example, the resistive heater has a tendency to become damaged over time, and the practical service life of the ink jet head is accordingly short. This is believed to be caused by the repeated rapid, heating and cooling of the drive means and the impact of bubble dissipation.

Another type on "ink-on-demand" print head incorporates an electrostatic actuator. This type of print head utilizes electrostatic force to cause the ink to be ejected. Examples are discussed in U.S. Pat. No. 4,520,375 by Kroll and in Japanese Laid-Open Patent Publication No. 289351/90. The ink jet head discussed in the Kroll patent uses an electrostatic actuator comprising a diaphragm which constitutes a part of an ink ejection chamber and a base plate disposed outside of the ink ejection chamber oppositely against the diaphragm, and ejects ink droplets from a nozzle connected to the ink ejection chamber by applying a time varying voltage between the diaphragm and the base plate. On the other hand, the ink jet head of the latter patent application distorts its diaphragm by applying voltage to an electrostatic actuator fixed on the diaphragm resulting in ink suction into an ink ejection chamber, and after then, restores the diaphragm obtaining an ink ejection by removing the voltage applied.

However, the drive apparatus or method that efficiently utilizes the characteristics of the semiconductor substrate to drive the ink jet head employing an electrostatic force has not been described in detail. In these conventional devices, it has not been possible to assure more stable drive characteristics.

One problem is that there may be a large difference in the current value according to the polarity of the applied voltage in the contact of the metal and semiconductor in the electrode because of the affect of the space-charge layer (also known as "depletion layer").

The space-charge layer is regarded as a capacitor not a conductor, and causes undesirable phenomena for an actuator of an ink jet head, for example, a decrease in displacement of the diaphragm, or an increase of the drive voltage to eject the ink droplets.

Regarding this problem, in U.S. Pat. No. 4,520,375, a time varying voltage is impressed on the capacitor which causes the diaphragm to be set into mechanical motion and the fluid to exit responsive to the diaphragm motion. However, U.S. Pat. No. 4,520,375 provides little guidance about the characteristics of semiconductor materials or few details on how to effectively drive such a print head.

In the case of the capacitor plate having the diaphragm is P-type semiconductor substrate and an alternating voltage having no bias voltage is applied to the actuator, the substrate acts as a conductor when a positive charge is applied to the substrate electrode, but when a negative charge is applied, the substrate does not act as a conductor and has capacitance due to the presence of the space-charge layer. As a result, the displacement of the diaphragm having applied a positive voltage is different from that having applied a negative voltage. As a result of this condition, there is a tendency of the ink droplets not being ejected uniformly, which deteriorates a print quality.

In another example, an alternating voltage is added to a bias voltage so that the polarity of voltage applied to the diaphragm is fixed. In this situation, a very large voltage is needed to deform the diaphragm and eject ink due to the presence of the space-charge layer if the applied voltage has an unsuitable polarity.

The following is a detailed description of the operation principal of an electrostatic actuator for applying to ink jet head.

When a voltage is applied to the gap between the diaphragm and an oppositely placed electrode, the resulting electrostatic force causes the electrode to attract the diaphragm, thus bending it. On the other hand, when bent, the diaphragm generates a restoring force in the opposite direction. Therefore, the extent of the bending of the diaphragm during the application of a voltage to the electrostatic actuator, i.e., the displacement of the mid-section of the diaphragm (hereinafter referred to as "the extent of the diaphragm displacement" or "diaphragm displacement") represents a value at which the electrostatic force and the diaphragm's restoring force are in equilibrium. If P denotes the restoring force of the diaphragm, x the displacement, and C the compliance of the diaphragm, the three variables can be expressed in the following equation:

$$P=x/C \tag{1}$$

Likewise, if Va denotes the effective voltage, G the distance between the diaphragm and the electrode (hereinafter "electric gap length"), and e the permittivity of the gap, then the electrostatic force generated between the diaphragm and the electrode can be expressed as:

$$P=e/2\{Va/(G-X)\}^2 \tag{2}$$

The position at which the displacement of the diaphragm comes into equilibrium can be determined from Equations (1) and (2).

FIG. 34 is a characteristic chart depicting the relationship between the displacement and the restoring force of the diaphragm and the relationship between the displacement of the diaphragm and the electrostatic force that is generated. These relationships are obtained from Equations (1) and (2), respectively. In the figure, diaphragm displacement x is plotted on the horizontal axis, and the pressure generated by the restoring force of the diaphragm and the pressure generated by the electrostatic force are plotted on the vertical axis. The following parameters, used in the experiment, are also used in the calculations:

$$C=5\times10^{-18}[m^5/N], G=0.25[\mu m], e=8.85[pF/m]$$

The electrostatic forces, calculated for each applied voltage, are shown by curves in the figure. The relationship between the diaphragm displacement and the diaphragm restoring force is indicated by a straight line. Of two intersections between the straight line and each curve, the intersection on the left side indicates the extent of bending (displacement quantity) of the diaphragm at the particular voltage level that is applied. At a voltage level at which the restoring force and the electrostatic force of the diaphragm do not intersect (e.g., 35 V), the electrostatic force is always greater than the restoring force of the diaphragm, irrespective of the displacement of the diaphragm. Therefore, in this case the displacement tends toward infinity. In actuality, however, the existence of an oppositely placed electrode limits the displacement of the diaphragm to the position of the electrode. In applying such electrostatic actuators as described above to ink jet heads for actual printer products, there remain some problems to be solved as described below.

Improving the printing speed of a printer requires an increase in the frequency in which the ink jet head pumps out ink continuously, i.e., the response frequency of the ink jet head. When attempting to achieve a high response rate for the diaphragm, if the volume of the ink ejection chamber is increased rapidly by applying sudden pulse voltages and by supplying an electrical charge between the diaphragm and the electrode, in order to attract the diaphragm to the electrode rapidly, air bubbles intrude into the ink ejection chamber from the nozzle connected to the ink channel. In other words, the rapid vibrations of the ink in the ink ejection chamber cause the gases dissolved therein, such as the nitrogen, to bubble up. As a result of these bubbles in the ink ejection chamber, any increase in pressure due to the decrease in volume of the ink ejection chamber caused by the sudden discharge of the electrical charge accumulated between the diaphragm and the electrode is absorbed or attenuated by the bubbles, thus preventing effective ink ejection. Further, the rapid attraction of the diaphragm to the electrode causes secondary vibrations of the diaphragm which often causes the violent collision of the diaphragm against opposing electrode resulting in damage to the ink jet head.

In addition to the above problem, electrostatic actuators tend to be driven improperly by external noise and induction noise because they can be driven by a few electrical charge. In particular, since the electrostatic actuators of the on-demand type printers are often driven separately from their neighboring electrostatic actuators, the neighboring electrostatic actuators sometimes operate improperly due to the induction noise generated by the driving current for the electrostatic actuator disposed side by side. Also in the operation of this kind of printers, the driving interval, namely the period between one ink ejection and the next ink ejection, often becomes fairly long. In such cases, the problem of malfunction caused by external noise arises.

OBJECTS OF THE INVENTION

Accordingly, it is the object of the present invention to overcome the problems associated with conventional ink-on-demand type printer.

It is another object of the present invention to provide an ink-on-demand type printer having an electrostatic actuator.

It is a further object of the present invention to provide a method for driving an electrostatic actuator.

It is still another object of the present invention to provide an electrostatic actuator for printing more stability and reliably.

It is still a further object of the present invention to provide an electrostatic actuator for printing with a smaller pitch.

It is still yet another object of the present invention to provide an electrostatic actuator for high-speed printing.

It is still yet a further object of the present invention to provide a printer with an electrostatic actuator which is highly efficient and operated at a low drive voltage.

It is still yet an additional object of the present invention to provide a printer with an electrostatic actuator which practically eliminates the formation of bubbles in the ink during the printing process.

SUMMARY OF THE INVENTION

In accordance with an aspect of the present invention, a method for recording on a sheet comprises the step of providing a marking fluid jet head formed in a semiconductor substrate having a nozzle, a pathway in communication with the nozzle, and an actuator comprising a diaphragm provided at one part of the pathway, a first electrode provided in opposition to the diaphragm and a second electrode provided on a portion of the diaphragm, the first and second electrodes forming a capacitor. A first driving voltage signal is applied to the first and second electrodes to electrostatically attract the diaphragm towards the first electrode in a first direction to fill the pathway with marking fluid. The first electrode is electrically coupled to the second electrode causing the diaphragm to move in the opposite direction away from the first electrode to thereby eject the marking fluid from the nozzle.

In accordance with another aspect of the present invention, a method for recording on a sheet comprises the step of providing a marking fluid jet head formed in a semiconductor substrate having a nozzle, a pathway in communication with the nozzle and a diaphragm provided at one part of the pathway. A capacitor is formed having a first electrode and a second electrode arranged on the diaphragm. A charging voltage signal is applied to the capacitor to cause the pathway to fill with marking fluid. The capacitor is discharged to thereby eject the marking fluid from the nozzle.

In accordance with a further aspect of the present invention, a method for recording on a sheet comprises the step of providing a marking fluid jet head formed in a semiconductor substrate having an array of nozzles, corresponding pathways in communication with respective ones of the nozzles and corresponding diaphragms provided at one part of each the pathways. A plurality of capacitors are formed, each corresponding to respective ones of the pathways, each one of the capacitors having a first electrode and a second electrode disposed on a corresponding diaphragm. At least one of the nozzles is selected for printing a pattern by applying a charging voltage signal to at least a selected one of the capacitors to fill a respective one of the pathways with marking fluid, and discharging the selected ones of the capacitors charged in the previous step to thereby eject marking fluid droplets from the selected nozzles. The previous step is repeated to print successive patterns.

In accordance with still another aspect of the present invention, a recording apparatus comprises a marking fluid head having a nozzle, a pathway in communication with said nozzle, an actuator and a driving circuit. The actuator comprises a diaphragm provided at one part of the pathway, a first electrode provided in opposition to the diaphragm, and a second electrode provided on a portion of the diaphragm. The driving circuit selectively applies a first driving voltage signal to the first and second electrodes to electrostatically attract the diaphragm towards the first electrode in a first direction to fill the pathway with marking fluid, and electrically couples the first electrode to the second electrode causing the diaphragm to move in the opposite direction away from the first electrode to thereby eject the marking fluid from said nozzle.

In accordance with a still further aspect of the present invention, a recording apparatus comprises a marking fluid head having a nozzle, a pathway in communication with the nozzle, and an actuator comprising first and second electrodes. A driving circuit selectively applies a driving voltage signal to the first and second electrodes to fill the pathway with marking fluid and to eject the marking fluid from the nozzle. A first control means controls sets at least one of a duration for applying the driving voltage signal and magnitude of the driving voltage. The first control means comprises a voltage detection circuit for detecting the voltage across the first and second electrodes, and a charge detection circuit for detecting the charge accumulated across the first and second electrodes. A recording apparatus condition determination circuit determines at least one of (1) an input voltage to the recording apparatus, (2) ambient temperature, (3) ambient humidity, (4) amount of time the recording apparatus has been operating, (5) the temperature in the vicinity of the marking fluid jet head, and (6) ambient air pressure. The first control means sets at least one of the duration for applying the driving voltage signal and the magnitude of the driving voltage signal in accordance with the voltage detected by the voltage detection circuit, the charge detected by said charge detection circuit, and the recording condition determined by the recording apparatus condition detection circuit.

The following is an explanation of the operation of the present invention. FIG. 35 is a characteristic chart depicting the relationship between the displacement of the diaphragm and the electrostatic capacity of the actuator as determined by numerical calculations. In this figure, the horizontal axis represents the displacement of the diaphragm, and the vertical axis indicates the electrostatic capacitance. A displacement of the diaphragm reduces the distance between the diaphragm and the individual electrode, thus increasing the electrostatic capacitance of the electrostatic actuator. In this case, the electrostatic capacitance changes in the range from approximately 200 pF to 1000 pF relative to the displacement of the diaphragm.

In order to produce a sufficient amount of ink ejection necessary for the printing, the gap between the diaphragm and the electrode in the ink jet head of the present invention is set at a minimum of 0.05 $\mu$m, and a maximum of 2.0 $\mu$m, taking into consideration practical voltage range applicable for ordinary printers. To minimize the drive voltage, the gap length should be as close to the lower limit as possible. However, a small gap length may cause the diaphragm and the electrode to come into contact with each other, as noted above. This situation has the risk of damaging or destroying the head.

The ink jet head drive method according to another aspect of the present patent application, provides a control means whereby either the duration or the voltage of the electrical pulses is set to an extent that does not cause the diaphragm to touch the electrode. This control mechanism prevents any of the following problems that are peculiar to ink jet heads using the electrostatic force: that the diaphragm and the electrode come into contact with each other, the circuit shorts, and the head is damaged or destroyed; and if a protective film is provided on both diaphragm and electrode, the diaphragm and the electrode touch each other through the protective film thus inducing an extremely large electric field on the protective film, and making the head liable to destruction. The present invention allows the gap length between the diaphragm and the electrode to be extremely small, thus permitting the ink jet to operate at a low drive voltage level while also ensuring a long service life for the ink jet head in practical situations.

In another aspect of the present invention, the amount of electrical charge that builds up between the diaphragm and the electrode can be controlled by either detecting the voltage between the diaphragm and the electrode or by integrating the current flowing to either the diaphragm or the electrode. The detected value can be compared with a predetermined value representing charge quantity that ensures that the diaphragm and the electrode do not touch each other. When a measured value reaches a prescribed value, the voltage applied to the gap between the diaphragm and the electrode can be reduced or stopped, in order to preclude any contact between the electrode and the diaphragm. In this manner, damage to the head, as noted above, can be prevented.

In still another aspect of the present invention, the ink jet head drive method of this invention involves the following process: first, a charge circuit for providing an electrical charge to the electrode and the diaphragm is connected to either the electrode or the diaphragm in order to attract the diaphragm to the electrode and to suction the ink; then, the charge circuit is disconnected when the bent diaphragm, while not touching the electrode, is at a position that ensures that enough ink is suctioned for output, thus stopping the ink suctioning process; this condition is maintained until the amplitude of the vibrations of the ink system reaches a maximum; and then, the discharge circuit, which releases the electrical charge that accumulated between the electrode and the diaphragm, is activated. This suddenly discharges the electrical charge stored between the electrode and the diaphragm, pressurizes the ink, and thus ejects ink droplets. The reason for the inclusion of this process is that, in the vibrations of the diaphragm and of the ink system, the flow resistance determined by the channel shape and the viscosity of the ink causes the phases of the ink system vibrations to lag to some extent behind the vibrations of the diaphragm. Therefore, after the displacement of the diaphragm is stopped where the diaphragm and the electrode are not in contact with each other, the ink is pressurized just when the peak of the vibrations of the ink system reach a maximum. The result is an efficient output of ink.

In still another aspect of the present invention of the ink jet head drive method, it involves the following process: the applied voltage is gradually increased, the diaphragm is attracted to the electrode by means of the electrostatic force, and the volume of the ink channel is increased. After that, the applied voltage is reduced gradually, and the electric charge stored between the electrode and the diaphragm is released so as to reset the volume of the ink channel to the standby volume. In this manner, the ink jet head is driven in such a way that ink droplets are ejected out from the nozzle. This makes it possible to apply a voltage to the gap between the diaphragm and the electrode so that the negative pressure on the ink, which occurs in the ink channel when the diaphragm is attracted to the electrode, is no greater than $2\times10^5$ pascal. In contrast to the problems described above, this method ensures that no air is sucked in from the nozzle and that the nitrogen, dissolved in the ink, does not bubble up in the ink channel. The result is a consistently stable ink ejection. Further, because the diaphragm is not rapidly attracted to the electrode, there is no danger of the diaphragm ever touching the electrode and any damage to the head can thus be prevented.

Further, by providing a charge circuit that supplies an electrical charge to the gap between the electrode and the diaphragm and a discharge circuit that releases the electrical charge and by setting the time constant for the charge circuit to ½ or less of the duration of the electrical pulses, the charge amount can reach approximately 90% of the capacity of the capacitor, which is composed of the diaphragm and the electrode. This ensures that enough ink is suctioned for adequate output, and eliminates the need to sacrifice the responsiveness of the head, in contrast to the problem noted above.

In still another aspect of the present invention, by varying stepwise the electrical charge that is stored in the gap between the electrode and the diaphragm through the application of electric pulses, the diaphragm is also attracted stepwise to the electrode. In this manner, too, the above-noted problems can be avoided.

In addition to the above implementation forms, this invention provides a means of detecting the operating environment for the ink jet printer as well as a charge condition storage means in which charge/discharge conditions that are appropriate to the operating environment are stored, which allow changes in charge time, beginning-of-discharge timing, the amount of charging electrical charge, and the rate of change. Thus, even when there are changes in ink jet printer power supply voltage or ambient temperature, the effects obtained in the various implementation forms can be maintained stably.

In the printer of the present invention, the discharge state of the electrostatic actuator is maintained during the non-operation interval from the discharge to the beginning of succeeding charge of the electrostatic actuator, thus preventing the electrostatic actuator from operating improperly due to the external noise or induction noise.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DESCRIPTION OF THE PREFERRED EMBODIMENTS

The preferred embodiments of the present invention are described below with reference to the accompanying figures.

First Embodiment

Figure 1:
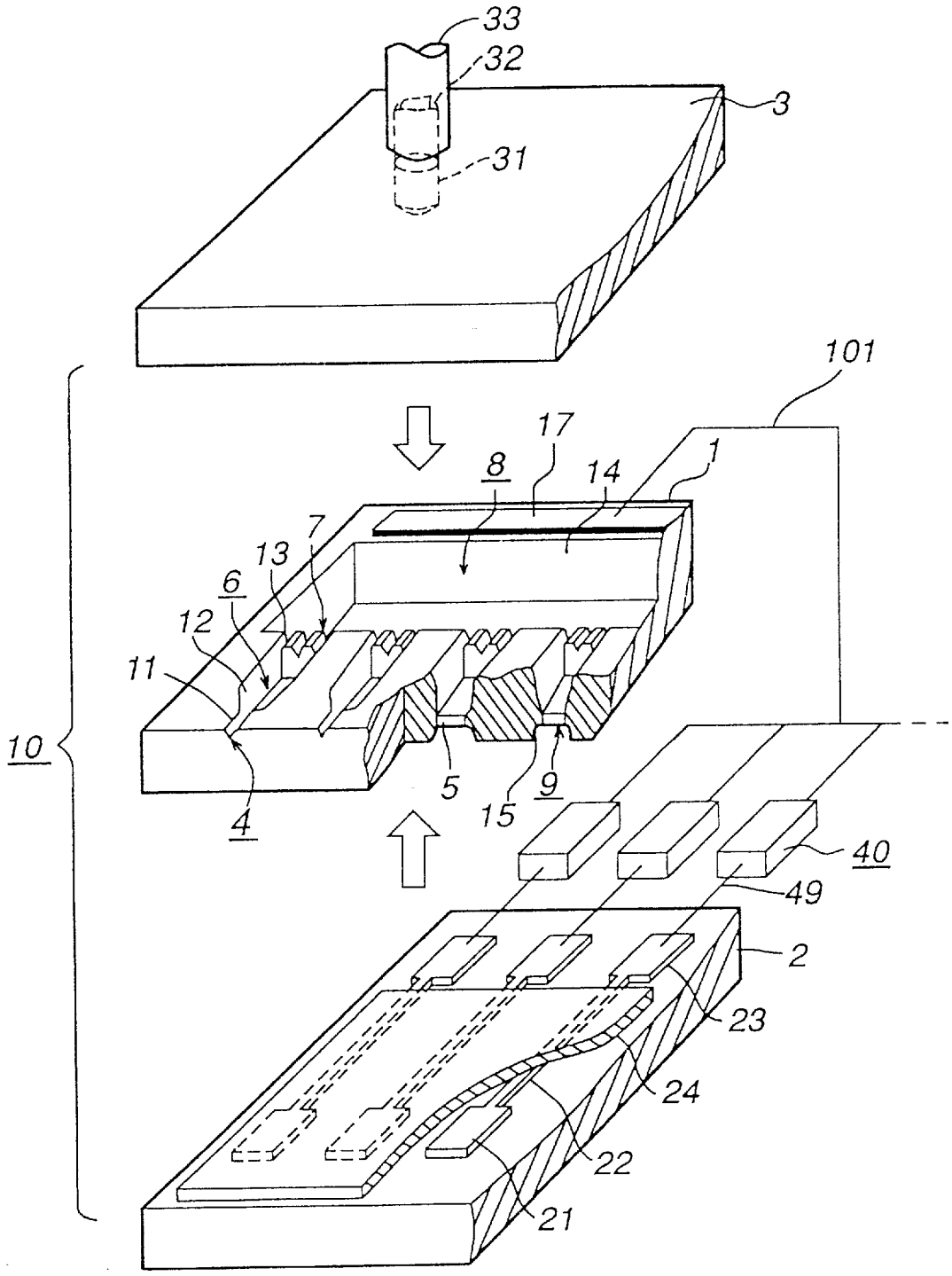
FIG. 1 is an exploded, perspective view of an ink jet head in accordance with the preferred embodiment of the present invention.
Figure 2:
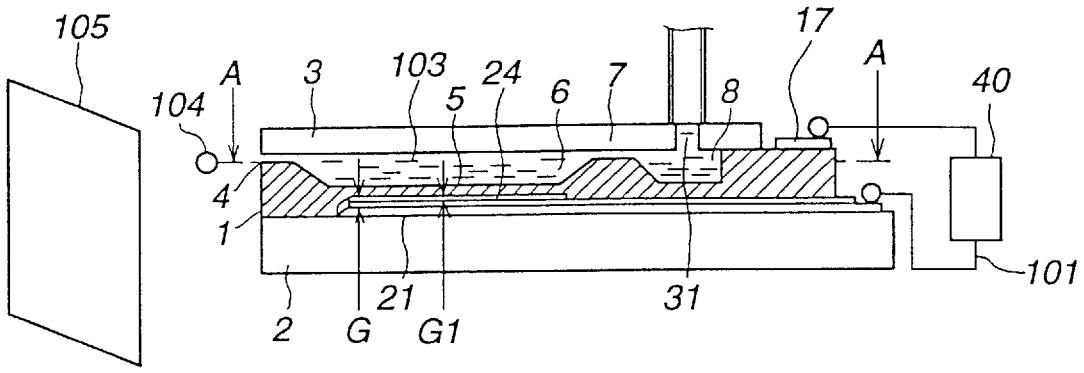
FIG. 2 is a lateral cross-sectional view of the ink jet head of FIG. 1.
Figure 3:
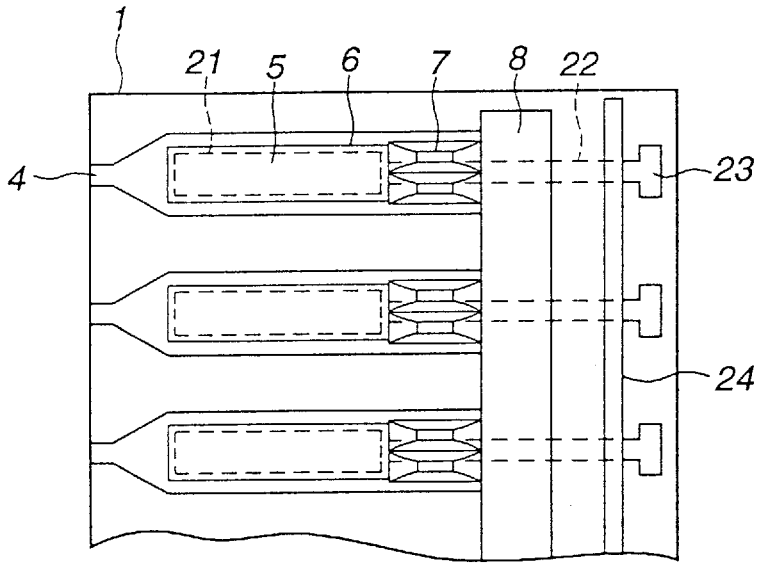
FIG. 3 is a cross-sectional view of the ink jet taken along line A—A of FIG. 2.

FIG. 1 is a partially exploded view of the ink jet head 10 for an embodiment of the present invention. This embodiment is an example of an edge-eject ink jet head that ejects ink droplets from nozzle holes that are provided at the edge of a substrate. FIG. 2 shows an overall lateral cross-section of the assembled ink jet head FIG. 1. FIG. 3 is a cross-sectional view of FIG. 2 along line A—A. Ink jet head 10 of this embodiment has a stacked structure, comprising three substrates, 1, 2, and 3, that are stacked and joined together as described below.

As shown in FIG. 1, the ink jet head 10 in the preferred embodiment comprises a first substrate 1, arranged between second substrate 2 and third substrate 3. Substrate 1 comprises a silicon substrate. While the presently preferred embodiment employs silicon, as will be appreciated by one of ordinary skill in the art, the present invention is not limited to silicon and any other suitable material may be employed. The surface of this substrate contains nozzle grooves 11 that form nozzles 4 and form parallel, equidistant patterns. A concave section 12, which is connected to or in communication with the nozzle grooves or pathway 11, comprises an ink ejection chamber 6 whose bottom wall is constituted by a diaphragm 5. Narrow grooves 13 provided in the rear portion of concave sections 12 and orifices 7 are fabricated for leading the ink into the ink ejection chamber 6. A concave section 14, which comprises a common ink cavity 8, supplies a marking fluid such as ink to each of the ink ejection chambers 6. It will be appreciated that marking fluid includes any fluid used for recording on a recording sheet. In the lower portion of the diaphragm 5, a concave section 15 is provided which forms vibration chamber 9 when the second substrate 2 is joined, as described hereinbelow.

Referring to FIGS. 2 and 3, the opposing interval between diaphragm 5 and oppositely placed individual electrode 21, i.e., the length G of a gap section 16 (hereinafter "electric gap length"), can be obtained as the difference between the depth of concave section 15 and the thickness of electrode 21. In this embodiment, concave section 15 of vibration chamber 6, that serves as an interval retention or gap holding means for defining the electric gap length, is formed on the back of first substrate 1. In another example, the concave section may be formed on the top surface of second substrate 2 (not shown). In the present embodiment, the depth of concave section 15 is preferably defined as 0.6 $\mu$m through etching. It should be noted that the pitch of nozzle groove 11 is 0.72 $\mu$m, having a width of 70 $\mu$m.

In this embodiment, a common electrode 17, which is provided in the first substrate 1, is made of either platinum with a titanium base or gold with a chromium base. The selection of these materials takes into consideration the magnitudes of the work functions of first substrate 1 as a semiconductor and metal for the common electrode. In the preferred embodiment, the magnitude of the work function of the semiconductor and the metal used for the electrodes is an important factor determining the effect of common electrode 17 on first substrate 1. The semiconductor material used in this embodiment therefore has a sheet resistance of 8~12 Ωcm, and the common electrode is made from platinum with a titanium backing or gold with a chrome backing. The present invention shall not be so limited, however, and various other material combinations may be used according to the characteristics of the semiconductor and electrode materials. Obviously, other electrode formation techniques that are known can also be employed.

In the preferred embodiment, a boron silicate-based glass, such as Pyrex® glass, is used as second substrate 2. Second substrate 2 is then joined to the underside of first substrate 1 in order to form a vibration chamber 9. Gold is then sputtered to a thickness of 0.1 μm on the corresponding sections of the second substrate to diaphragm 5, thus forming individual electrodes 21. Thus electrodes 21 are made of gold and have substantially the same shape as diaphragms 5. Individual electrodes 21 are provided with corresponding leads 22 and terminals 23. Further, the entire surface of the second substrate 2 except for the electrode terminals 23 is coated with boron silicate-based glass, to a thickness of 0.2 μm in order to form an insulator 24 by using the sputter method. Preferably a 0.2 μm thick insulation layer 24 for preventing dielectric breakdown and shorting during ink jet head drive is formed from a Pyrex® sputter film on second substrate 2 but not over terminal members 23. The film thus formed prevents insulation breakdown and shorting during the operation of the ink jet head. Second substrate 2 is then joined to the underside of the first substrate forming the vibration chamber 9.

Third substrate 3, which is joined to the top surface of the first substrate 1 by known techniques is made of a boron silicate-based glass similar to second substrate 2. Joining third substrate 3 to the first substrate forms nozzle holes 4, ink ejection chamber 6, orifice 7, and ink cavity 8. Third substrate 3 is provided with an ink supply inlet or port 31 in communication with ink cavity 8. Ink supply inlet 31 is connected to the ink tank or reservoir (not shown in the figures) through a connecting pipe 32 and a tube 33.

As a next step, first substrate 1 and second substrate 2 are bonded by using the anodic-bonding method through the application of a 300° C.~500° C. temperature and a 500~800V. Likewise, first substrate 1 and third substrate 3 are joined under similar conditions in order to assemble the ink jet head, as shown in FIG. 3. The electric gap length G, which is formed between individual electrodes 21 that are formed on second substrate and each corresponding diaphragm 5 upon completion of the anodic-bonding process, is equal to the difference between the depth of concave section 15 and the thickness of individual electrode 21. In the preferred embodiment, this value is defined as 0.5 μm. Likewise, the mechanical gap length, G1, formed between diaphragm 5 and insulator 24, that covers the individual electrodes 21, is 0.3 μm.

To drive the ink jet head having the above configuration conductors or wires 101 are used to electrically connect a drive circuit or electrostatic actuator driver 40 to common electrode 17 and to terminal sections 23 of respective individual electrodes 21. The detailed operation and construction of drive circuit 40 will be discussed hereinbelow. Ink 103 is supplied from an ink tank (not shown) through ink supply inlet 31 and fills the ink channel or pathways, such as ink cavity 8, and ink ejection chamber 6. When ink jet head 10 is operated, ink in the ink ejection chamber 6 is then transformed into ink droplets by nozzle holes 4 and ejected, as shown in FIG. 3 for recording or printing on the recording paper 105.

Figure 4A:
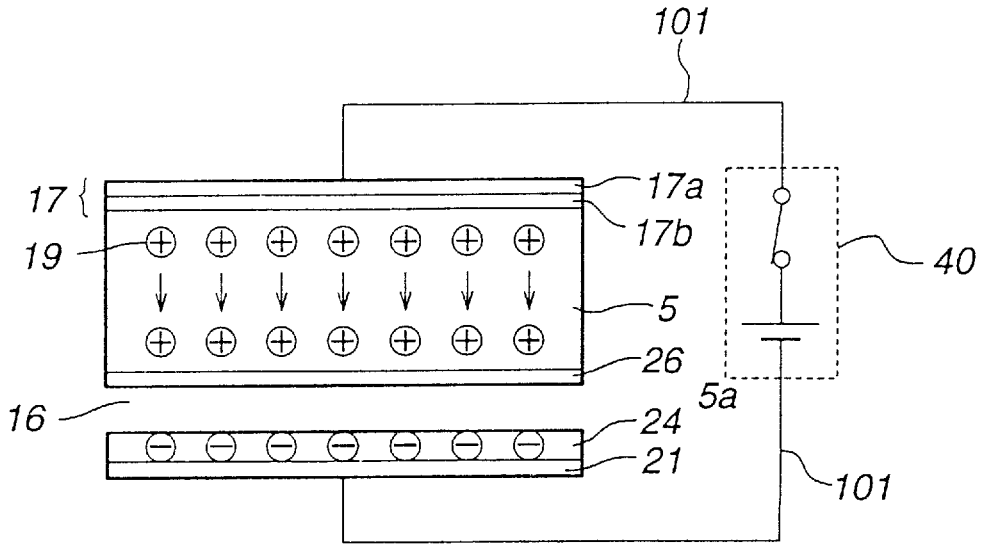
FIG. 4A is a simulated view of the diaphragm and individual electrode charge states in the preferred embodiment of the present invention.

The following is an explanation of the electrostatic actuator of the present embodiment. FIG. 4A is a partial, detailed model diagram of diaphragm and individuals 21 electrode of the present embodiment, and shows a model view of the status of the electrical charge. In this figure, P-type silicon is used as first substrate 1. As shown therein, electrode 17 is composed of an upper layer 17*a* comprising either platinum or gold and a lower or base layer 17*b* comprising titanium or chrome.

The electric potential of common electrode 17 is made higher than that of the individual electrode 21. The side of diaphragm 5 that faces the individual electrode is given oxidation treatment so that an oxide film 5*a* of 0.1 μm to 0.2 μm thick is formed thereon. Additionally, a protection film 24 that is provided on the side of individual electrode 21. Oxide film 5*a* prevents electrical contact or shorting in the event of physical contact between diaphragm 5 and electrode 21. Preferably, P-type silicon of the present embodiment contains diffused boron (B). It is known that P-type silicon contains as many positive holes in accordance with the number of boron atoms. Referring to FIG. 4A, positive holes 19, existing in the P-type silicon, migrate in diaphragm 5 toward the oxide film 5*a* due to the electric field which is oriented in the direction from common electrode 17 to individual electrode 21. The negative charges of boron, generated by the migration of positive holes 19, is neutralized by the positive charge which is supplied from substrate electrode 17. Therefore, the first substrate acquires a positive charge. Because it does not generate a spatial charge layer, first substrate 1 can be considered a conductor. Individual electrode 21, on the other hand, is charged negatively. Consequently, an applied voltage generates an electrostatic attraction between diaphragm 5 and individual electrode 21, thus causing diaphragm 5 to bend or be displaced toward individual electrode 21.

Figure 4B:
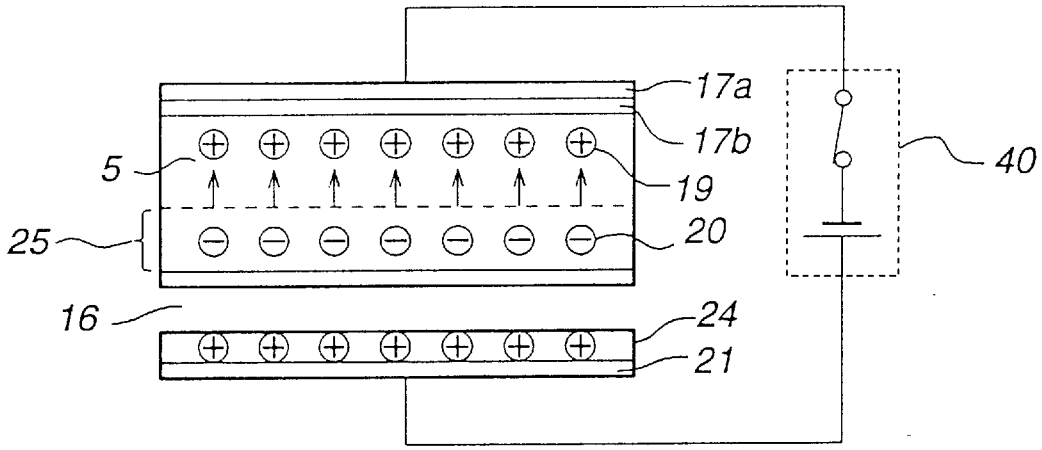
FIG. 4B is a simulated view of the diaphragm and individual electrode charge states having opposite charge states of that shown in FIG. 4A.

FIG. 4B is also a simulated view of the diaphragm and individual electrode charge states. The polarities of diaphragm 5 and individual electrodes 21, as shown in FIG. 4B, however, are the opposite of those in the first embodiment above with first substrate 1 being negative and individual electrodes 21 being positive, which is the opposite condition of that described with FIG. 4A. The electron holes 19 in the P-type silicon diaphragm 5 are attracted by the negative charge of common electrode 17 and move thereto, but because the boron doping agent is fixed to the silicon crystals and cannot move, the silicon is electrically separated into two layers, a first layer positively charged by electron holes 19 and a secondary layer or space-charge negatively charged by acceptors (ionized boron), wherein mobile holes do not exist. As a result, first substrate 1 has a capacitance determined by the depth of space-charge layer 25 and the dielectric constant of the silicon, and therefore functions as a capacitor. First substrate 1 therefore ceases to function as a conductor, and the electrostatic attraction force produced between diaphragm 5 and individual electrodes 21 decreases relative to the applied pulse voltage by an amount equivalent to the capacitance. As a result, diaphragm 5 does not deflect sufficiently, and ink jet performance cannot be assured. There are also cases in which deflection of diaphragm 5 becomes impossible, and it is not possible to drive the ink jet head using first substrate 1 as the negative electrode.

When an N-type silicon semiconductor is used for the substrate material and a negative charge is applied to the substrate, the substrate operates as a conductor because the negative charge is supplied to donor such as ionized arsenic from common electrode, which produces a current of electron in first substrate.

This is the opposite of what happens using a P-type semiconductor. When a positive charge is applied to the substrate, however, the substrate does not become a conductor and has capacitance due to the space-charge layer, wherein mobile electrons do not exist. As a result, this N-type silicon semiconductor substrate can be driven identically to a P-type semiconductor by applying a charge opposite that applied with a p-type semiconductor substrate, and good ink jet performance can be assured.

Figure 33:
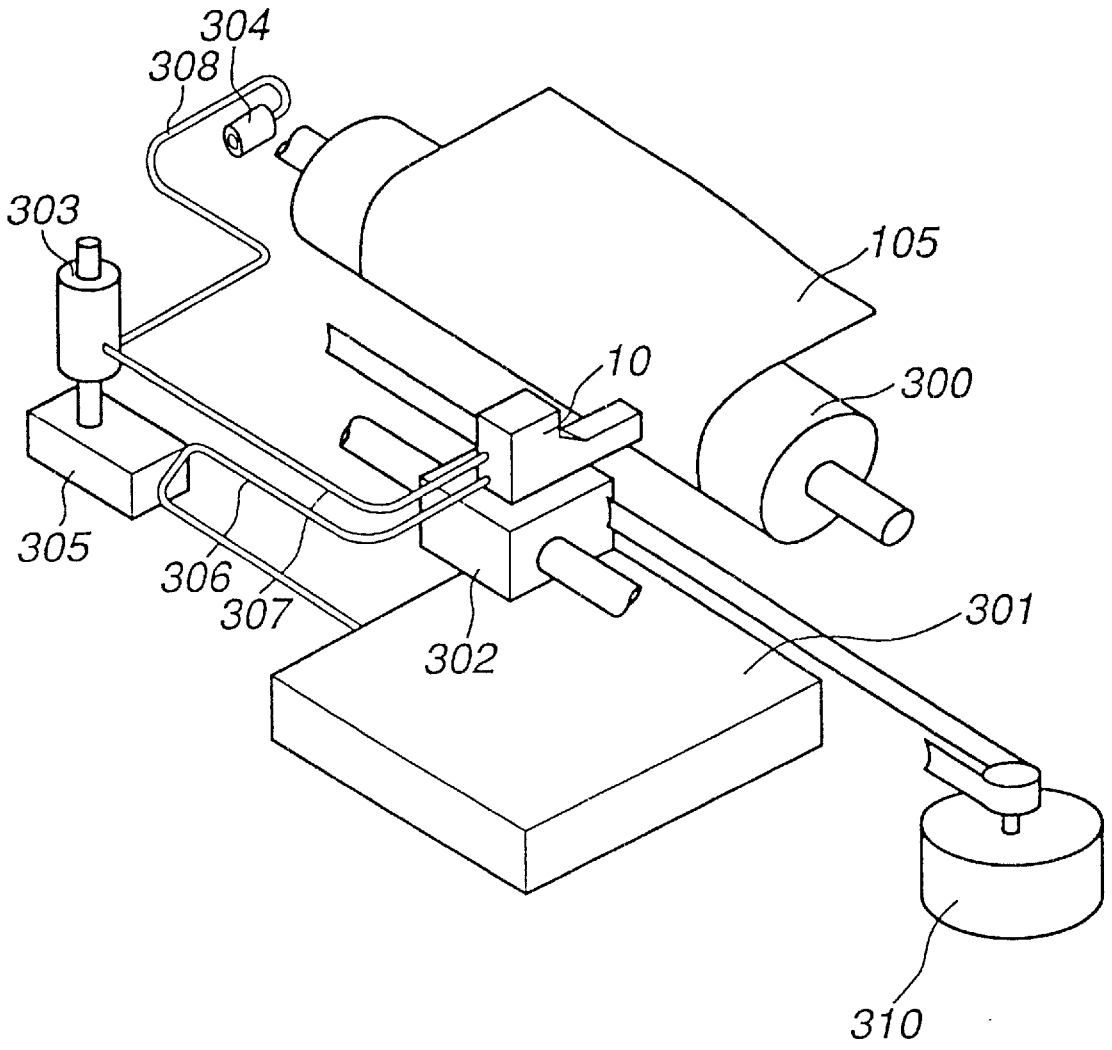
FIG. 33 is conceptual diagram of a printer having the electrostatic actuator of the present invention.

FIG. 33 shows an overview of an exemplary printer that incorporates the ink jet head 10 described above. Of course, as will be appreciated by one of ordinary skill in the art, various other types of printers may employ the ink jet head in accordance with the present invention. A platen 300 or paper transport means feeds recording sheet or paper 105 through the printer. Ink tank 301 stores ink therein and supplies ink to ink jet head 10 through ink supply tube 306. Ink jet head 10 is mounted on carriage 302 and is moved parallel to platen 301 by carriage drive means 310, preferably comprising a stepping motor, in a direction perpendicular to the direction in which recording paper 105 is transported. Ink is discharged appropriately from a row of nozzles in synchronization with the transfer of the ink jet head so as to print, for example, characters and graphics on recording paper 105. Because it is desirable to provide the drive circuit as close to the ink jet head as possible, the drive circuit is incorporated into ink jet head 10. In other embodiments the drive circuit may be separated and mounted on carriage 302. As shown in FIG. 33, a device is provided for preventing the clogging of the ink jet head nozzle, a problem peculiar to printers that incorporate on-demand-type ink jet heads. To prevent the clogging of the nozzle for the ink jet head 10 the ink jet head is positioned opposite cap 304, for discharging ink tens of times. Pump 303 is used to suction the ink through the cap (304) and the waste ink recovery tube 308 for recovery in the waste ink reservoir (305).

Figure 5:
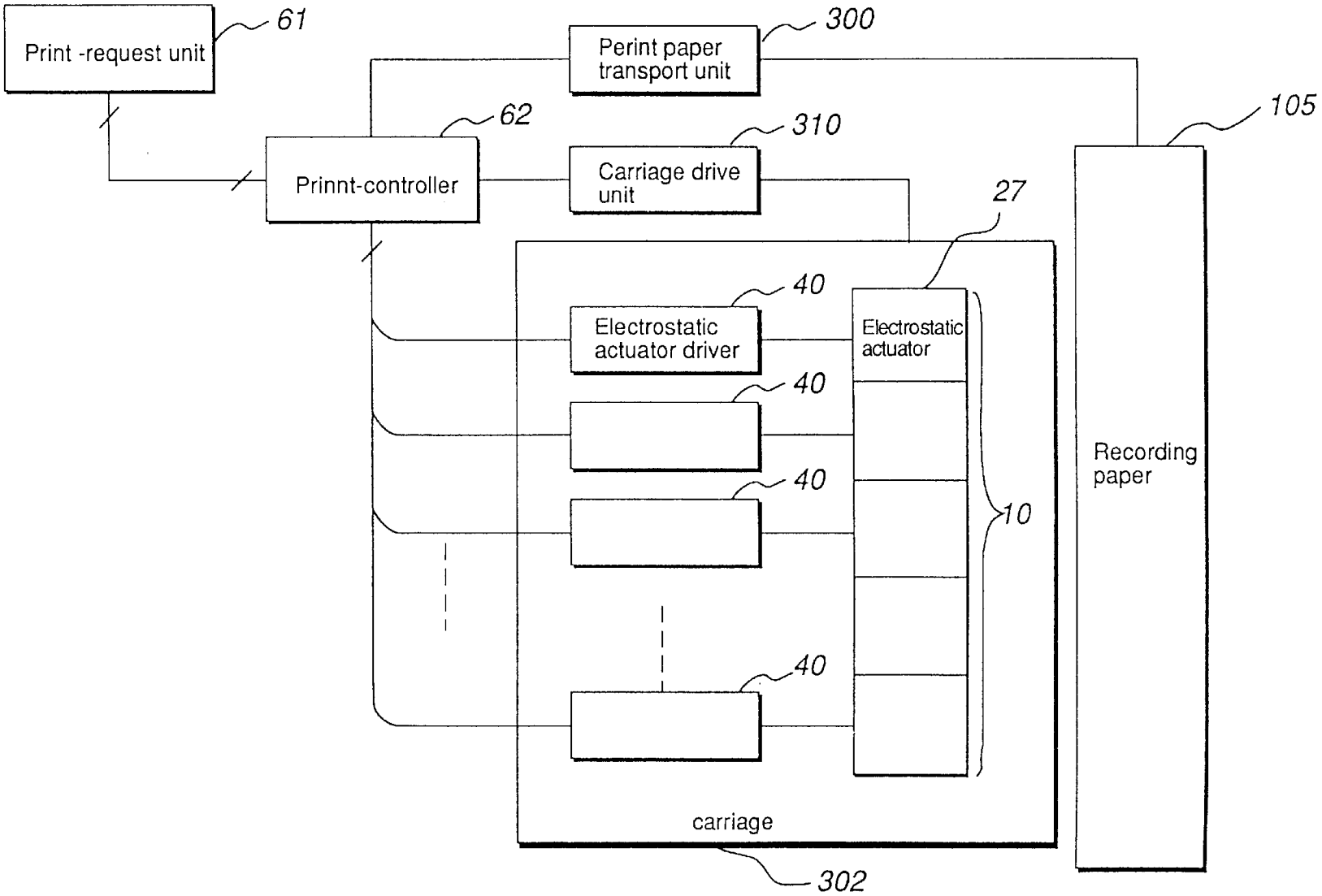
FIG. 5 is a block diagram of an ink jet printer according to the present invention.

FIG. 5 is a block diagram showing the configuration of the printer for an embodiment of the present invention for which a patent is sought. For example, in a terminal printer, the print request unit or device 61 is a host computer or another external device. In the case of a printer that is built into a system, it is a computing or processing section within the system.

When receiving a print request from the print request unit 61, the printer controller 62 sends a drive signal to both print paper transport section 300 and carriage drive 310. As a result, carriage 302, on which the ink jet head 10 is mounted, is moved to a specified position on the recording paper and performs the printing while moving carriage 302 in the direction of printing. Electrostatic actuator drivers 40 are connected to corresponding ones of electrostatic actuators 10. Printer controller 62 sends a start-of-print signal, S1 (FIG. 11) to selected electrostatic actuator drivers 40 corresponding to the dot positions at which the printing is to be performed, in accordance with the print data. Upon receiving this signal, the selected electrostatic actuator drivers 40 drive the respective electrostatic actuators 27. Preferably to reduce the resistive and inductive losses of conductors or wires 101 from the electrostatic actuators 40, electrostatic actuator drivers 40 should be mounted on the carriage in order to minimize the wire length thereof. However, the present invention is not limited by the wire length and other means may be employed to reduce the above-mentioned losses. For the purposes of the present invention, electrostatic actuator drivers 40 can be placed outside the carriage.

Figure 6:
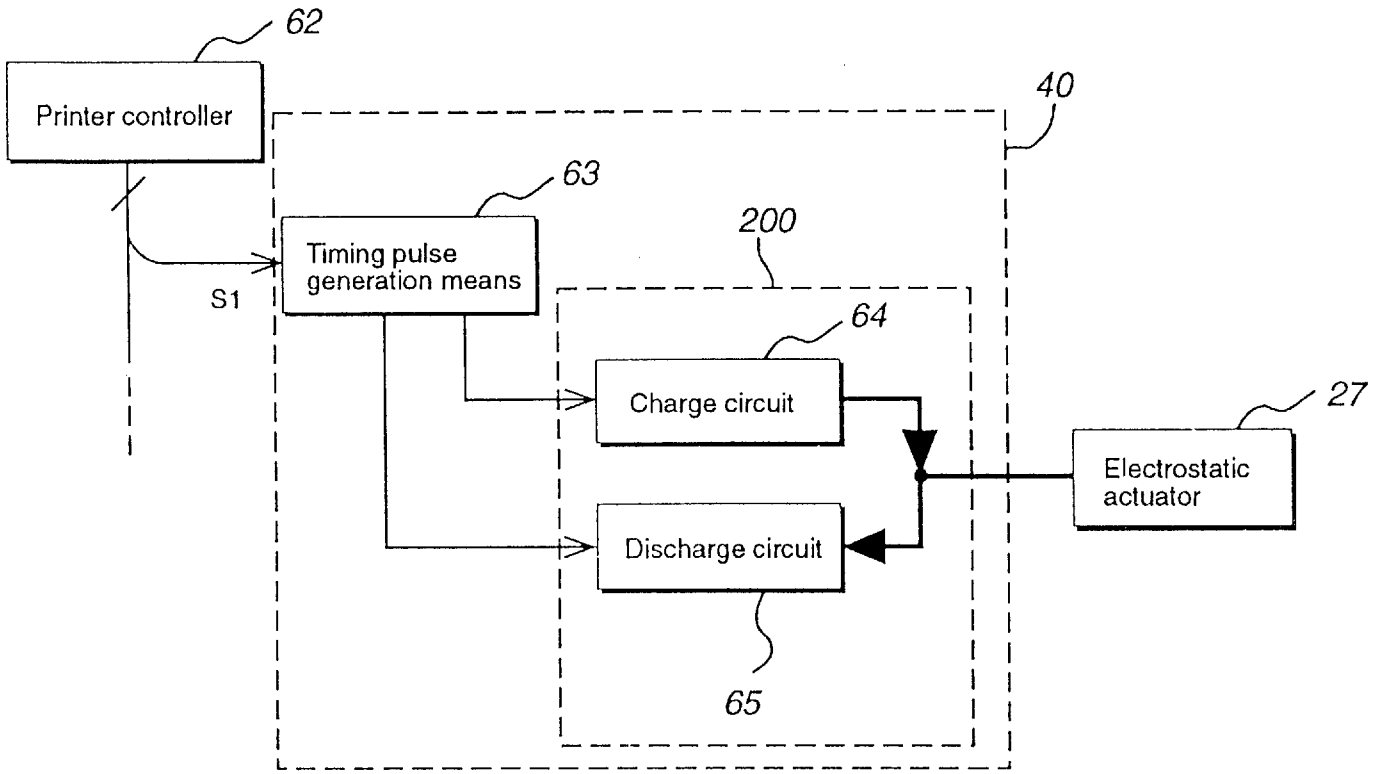
FIG. 6 is a block diagram for an electrostatic actuator driving circuit in accordance with the first embodiment of the present invention.

FIG. 6 shows a block diagram of an electrostatic actuator driver according to the first embodiment of the present invention. Electrostatic actuator driver 40 consists of a timing pulse generation means 63, a charging circuit 64, and a discharging circuit 65. When a start-of-print signal S1 is input into timing pulse generation means 63, timing pulse generation means 63 generates charging pulses of a specified width for output to charge circuit 64. Charge circuit 64 then supplies a charging current to the electrostatic actuator 27. As will be explained in detail hereinbelow, as actuator 27 is charged, the volume of ink ejection chamber 6 increases and ink is drawn therein. Subsequently, timing pulse generation means 63 sends discharging pulses of a specified width to discharge circuit 65. Discharge circuit 65 then discharges the charge stored in the electrostatic actuator 27, causing the volume of ink ejection chamber 6 to decrease thus ejecting the ink. The following is a detailed explanation of the configuration and action of the electrostatic actuator with reference to specific circuit examples. The charge circuit and discharge circuit taken together will be referred to as the charge/discharge means 200.

Figure 7:
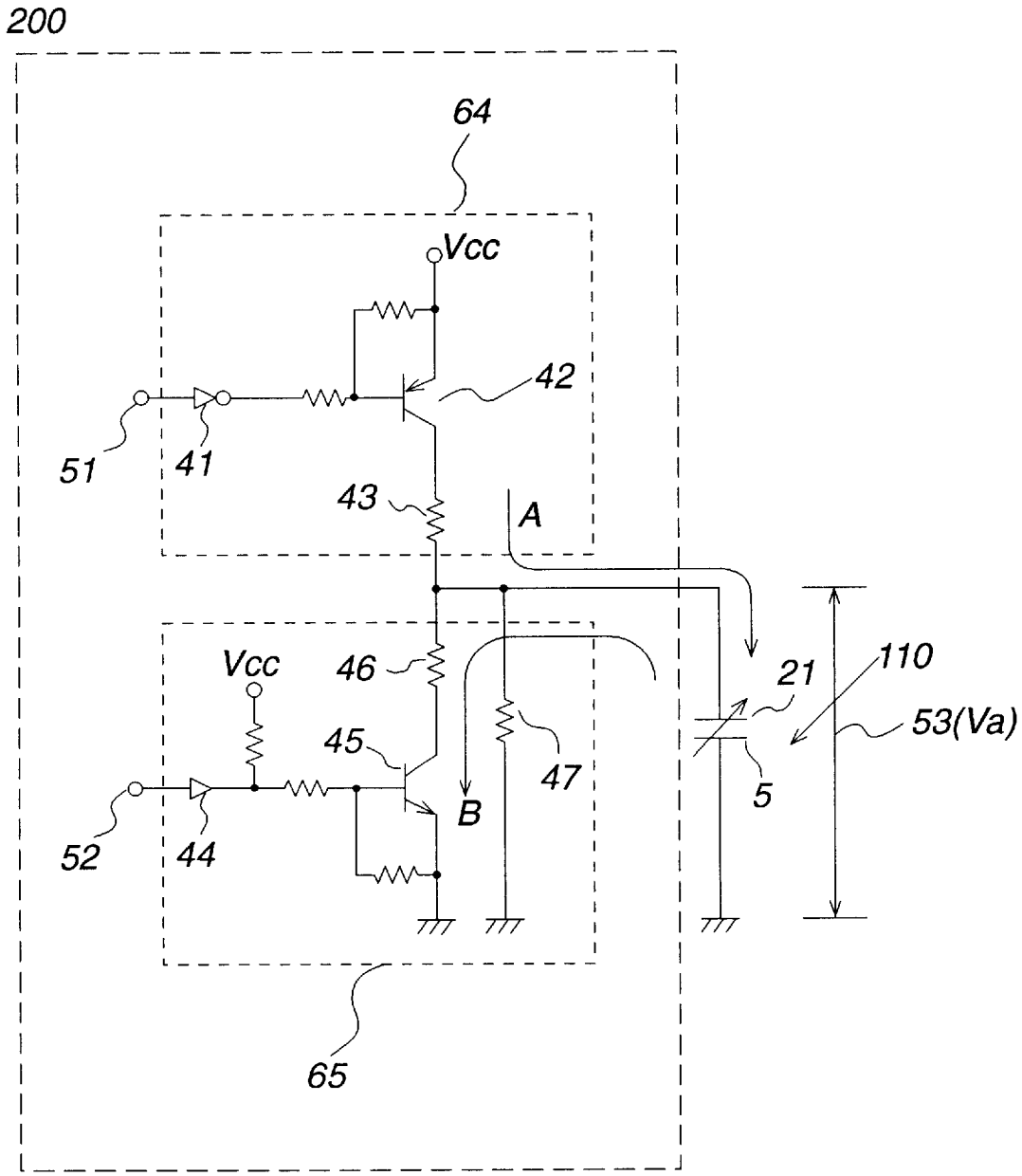
FIG. 7 is a schematic diagram of the electrostatic actuator driving circuit in accordance with another embodiment of the present invention.
Figure 7A:
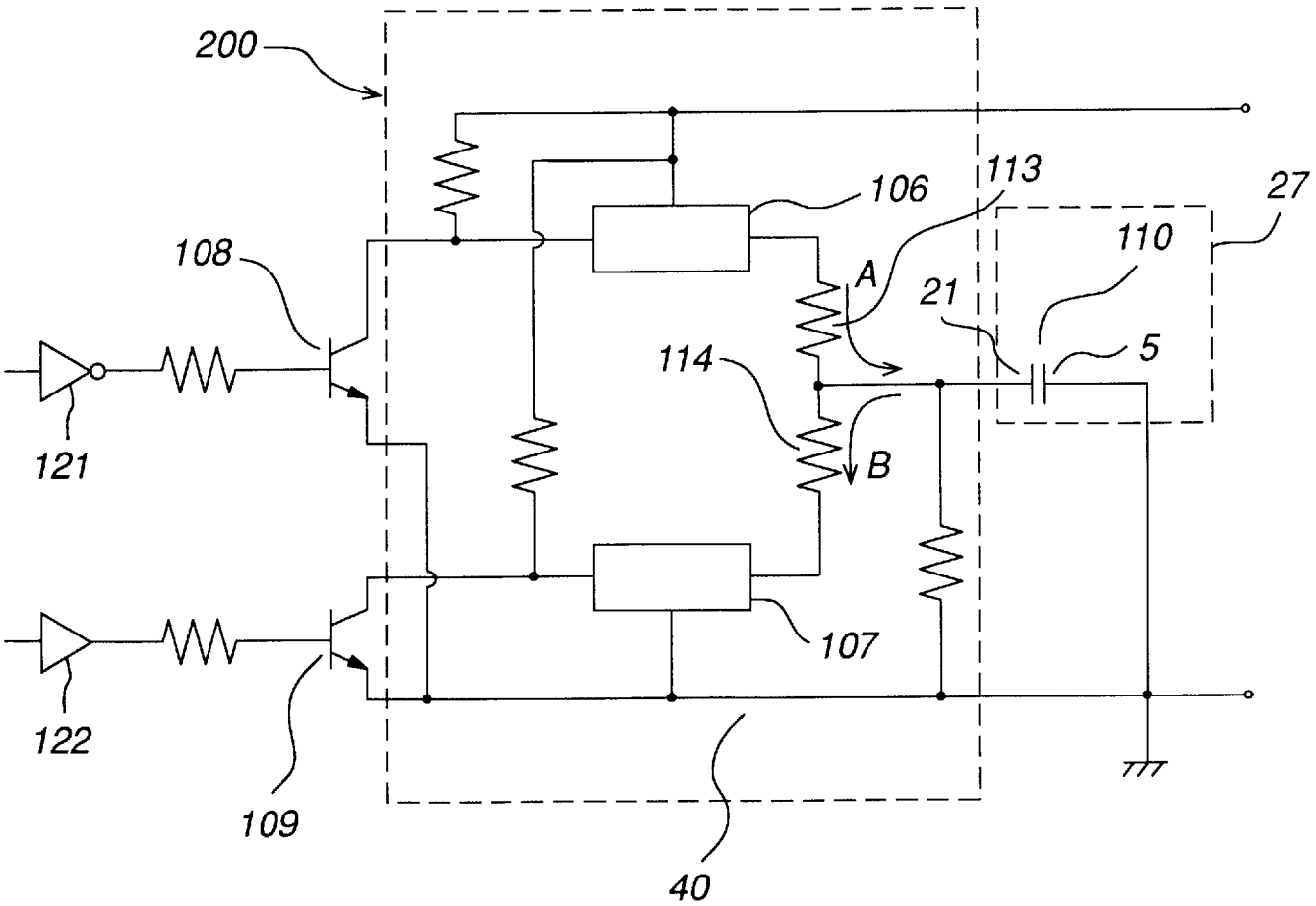
FIG. 7A is a schematic diagram of the electrostatic actuator driving circuit in accordance with the first embodiment of the present invention.

FIG. 7A is a schematic diagram of charge/discharge means 200 in accordance with the present invention. While the circuit of FIG. 7A is preferred, persons of ordinary skill in the art who have read this description recognize that various modifications and changes may be made therein.

Figures 8A, 8B:
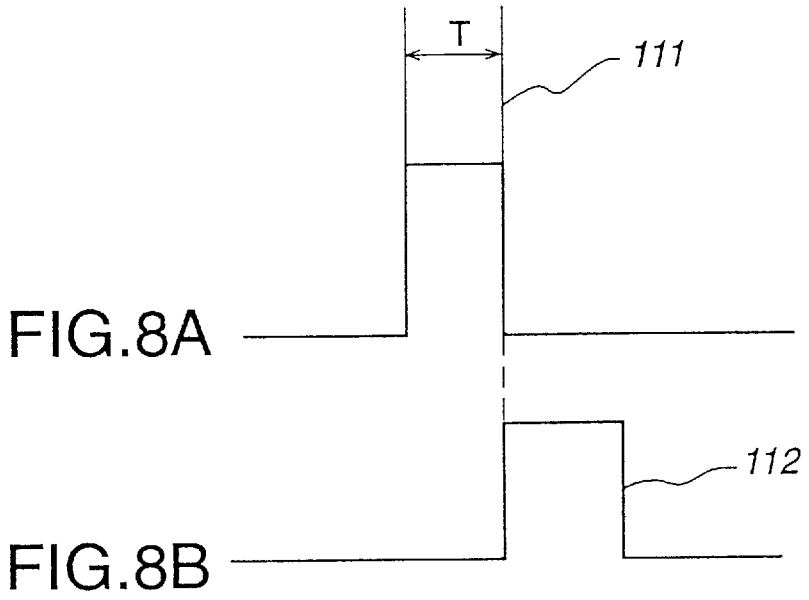
FIGS. 8A and 8B are timing diagrams of input signals to the driving circuit in accordance with the first embodiment of the present invention.
Figure 36:
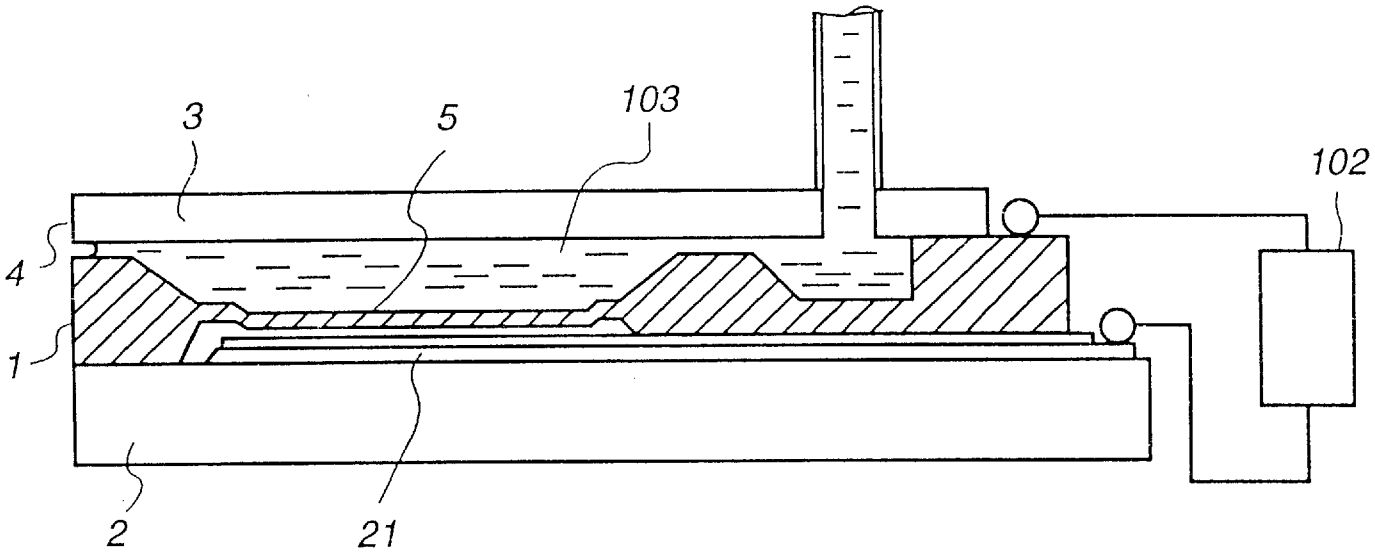
FIG. 36 illustrates the ink jet head state during electrostatic charging in the preferred embodiment of the invention.
Figure 37:
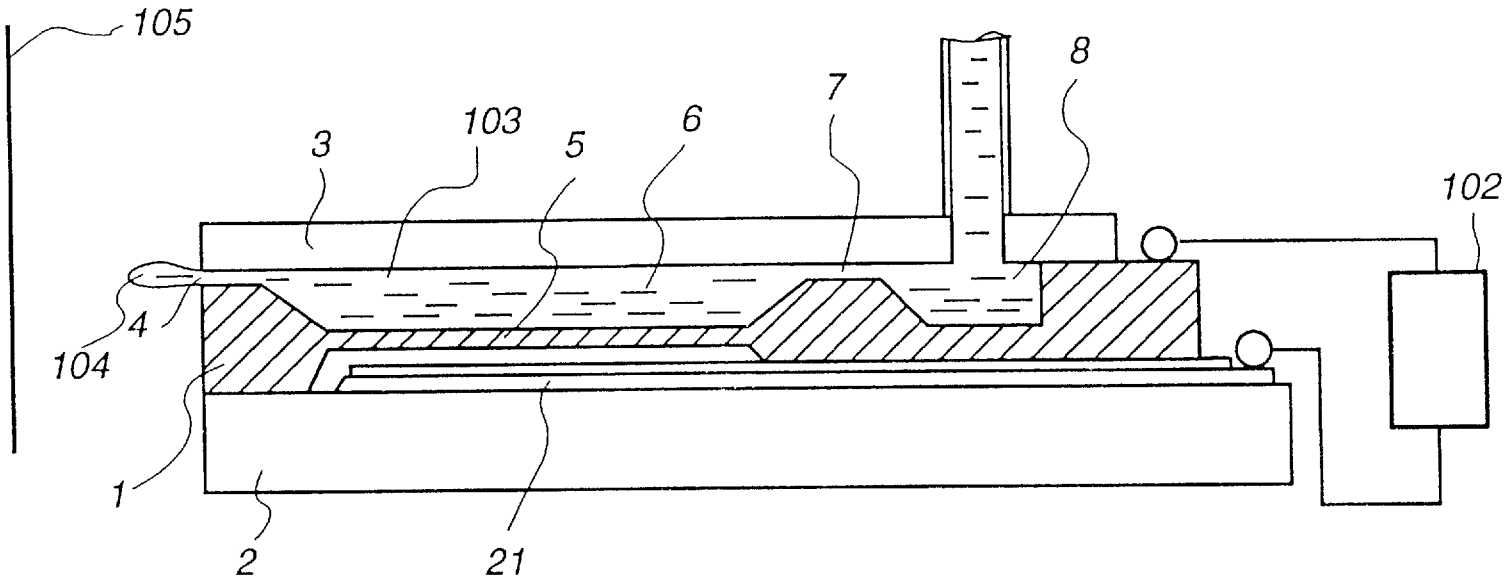
FIG. 37 illustrates the ink jet head state during electrostatic discharging in the preferred embodiment of the invention.

FIGS. 8A and 8B are timing charts of electrostatic charging. FIG. 8A is a time chart of the charge signal, and FIG. 8B is a timing chart of the discharge signal. FIG. 36 illustrates the ink jet head in the charge state and FIG. 37 illustrates the ink jet head in the discharge state ejecting ink droplets 104 toward recording sheet 105. As will be explained in detail hereinbelow.

Figure 9D:
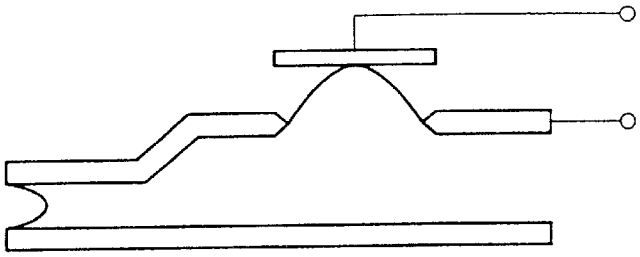
FIGS. 9A–9D are cross-sectional schematic representations of the various stages of operation of the electrostatic actuator in accordance with the present invention.
Figure 9C:
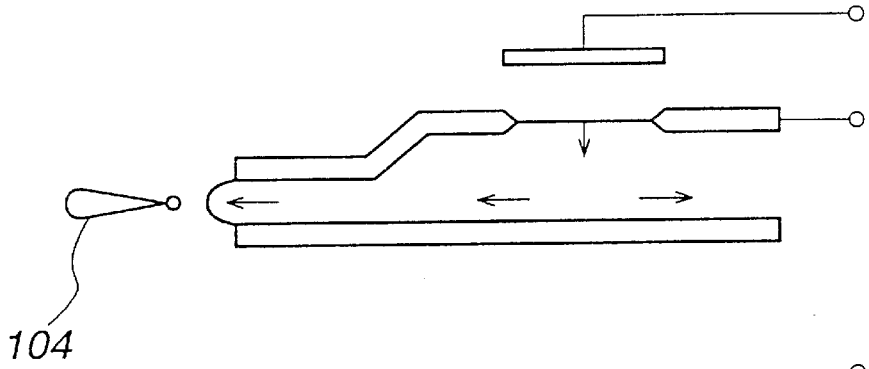
Figure 9B:
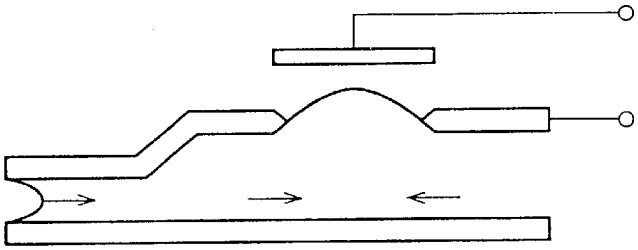
Figure 9A:
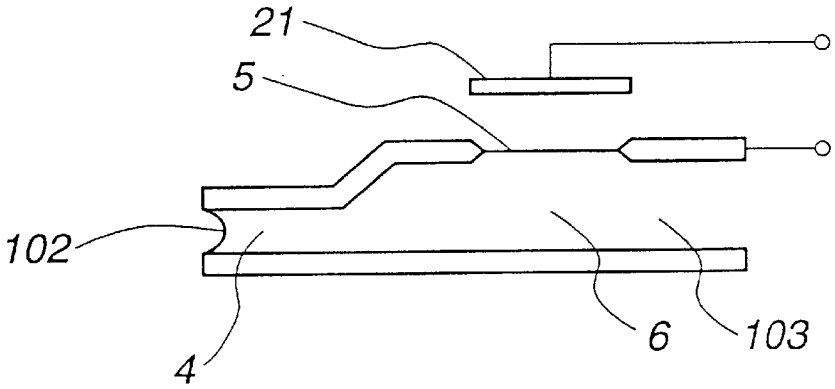

FIG. 9A illustrates the state of the ink jet head prior to the application of any signals. Referring to FIG. 7A again, when the ink eject signal, i.e. charge signal 111, is input to gate 121 of drive circuit 102 after connecting the preferred embodiment as described above, transistor 108 becomes ON, first switching element 106 becomes ON, current flows in the direction of arrow A and an electrostatic charge is formed between diaphragm 5 and individual electrodes 21. Capacitance 110 is charged at a rate substantially determined by time constant of resistance 113 and capacitance 110. Electrostatic attraction thus causes diaphragm 5 to deflect towards individual electrodes 21 as shown in FIG. 9B. After the predetermined drive charge time T has passed, discharge signal 112 is input to gate 122, transistor 109 becomes OFF, secondary switching element 107 becomes ON, current flows in the direction of arrow B, and the charge stored in diaphragm 5 is discharged in accordance with the time constant of the capacitance 110 and resistance 114. Gates 121, 122 and transistors 108, 109 form a decoding circuit. As a result, the attractive force caused by static electricity acting on individual electrodes 21 and diaphragm 5 dissipates, and diaphragm 5 returns to the original position due to its inherent rigidity. This causes the pressure inside jet chamber 6 to rise rapidly, and ink drop 104 is ejected from nozzle 4 to recording paper 105 (FIG. 9C). When diaphragm 5 is again deflected (toward individual electrodes 21), ink 103 is supplied from ink cavity 8 through orifice 7 to jet chamber 6, FIG. 9D. As will be appreciated by one of ordinary skill in the art, when an n-type semiconductor is used for the substrate, the connections between drive circuit 102 and ink jet head 10 are opposite those used with a p-type semiconductor. In the preferred embodiment, switching elements 106 and 107 may be bipolar transistors or MOS transistors.

FIG. 7 illustrates another example of the charge/discharge means 200. As shown therein, the charge circuit comprises and inverter 41 has input to switching transistor 42. The discharge circuit comprises a buffer 44 as input to switching transistor 45. The operation of the discharge/charge means 200 will now be explained.

Figure 8C:
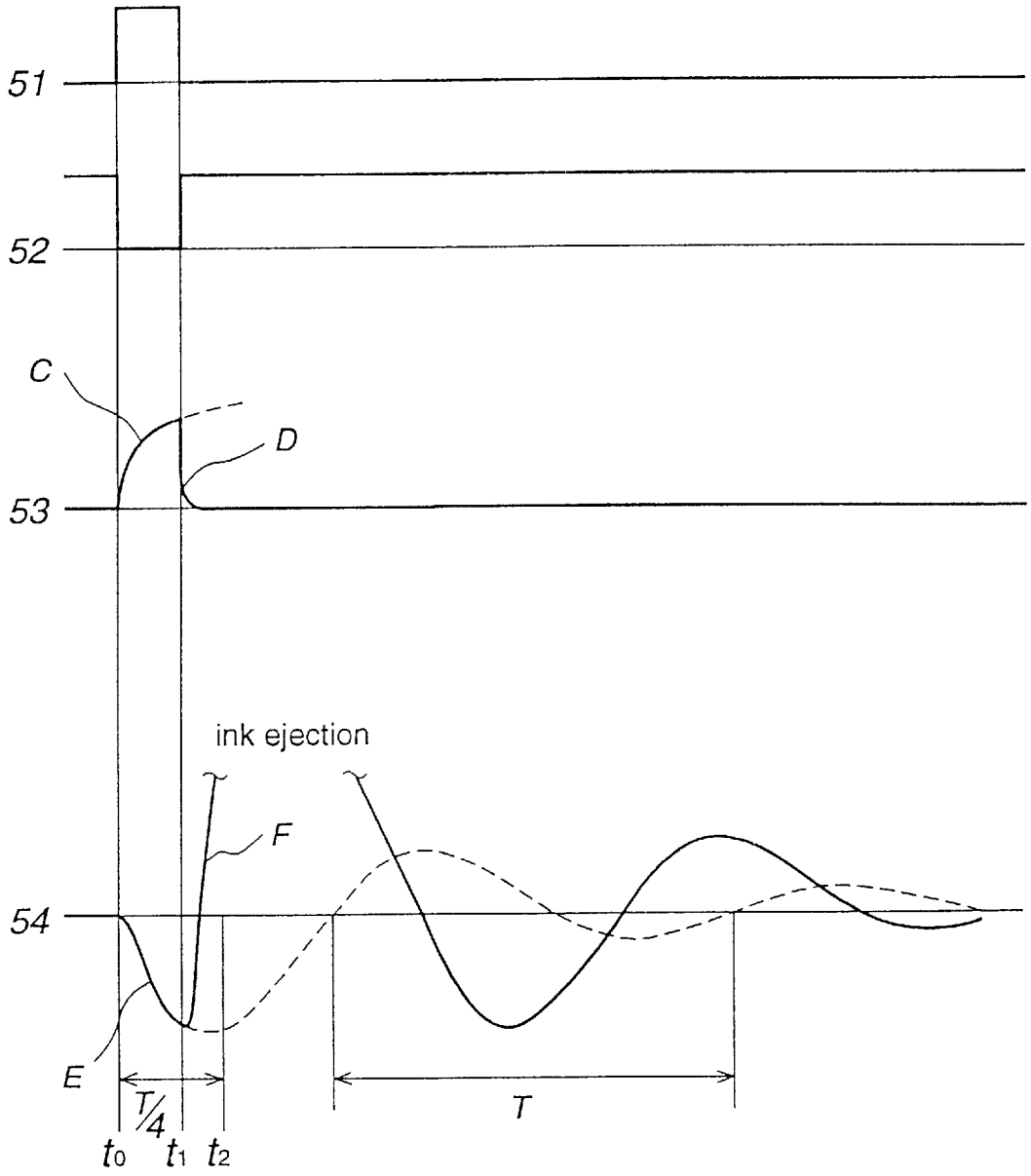
FIG. 8C is a timing diagram illustrating the input signals to the electrostatic actuator driver in accordance with the first embodiment of the present invention, diaphragm-electrode voltage wave forms, and the vibrations of the ink meniscus formed at the tip of the nozzle.

FIG. 8C shows input signals 51 and 52 that are supplied to the drive charge, and discharge circuits 64 and 65 respectively (FIG. 7). As shown in FIG. 8C, voltage waveform 53 is a voltage occurring across diaphragm 5 and electrode 21, and waveform 54 is the vibration of meniscus 102 of ink 103 that is formed at the tip of nozzle 4. FIGS. 9 A–D illustrate the conditions of the various stages in the vicinity of the ink ejection chamber 6 when diaphragm 5 is driven at the various stages of the driving operation.

Referring to FIGS. 7 and 8C, before time $t_0$, i.e., in the standby status, both transistors 42 and 45 are off. Consequently, no voltage is applied to the area between diaphragm 5 and electrode 21. Therefore, diaphragm 5 does not undergo a displacement. The ink ejection chamber 6 remains in a condition that does not exert any pressure on the ink 103, as shown in FIG. 9A.

When the charge signal 51 rises at time $t_o$, transistor 42 is switched on. This causes a voltage to be applied to diaphragm 5 and electrode 21. As a result, a current flows in the direction of arrow A. The electrical charge stored between diaphragm 5 and electrode 21 causes the electrostatic force to act between them. This, in turn, causes diaphragm 5 to be attracted to electrode 21, the volume of the ink ejection chamber 6 to increase, as shown in FIG. 9B, and the ink 103 in the vicinity of the ink ejection chamber 6 to be attracted in the direction of the arrow. During this time, the voltage 53 between diaphragm 5 and electrode 21 changes, as shown in portion C of FIG. 8C, due to the time constant which is substantially determined by resistor 43 and capacitance 110 of the head itself. As the diaphragm is displaced, the meniscus 102 varies as indicated by portion E in FIG. 8.

At time $t_1$, charge signal 51 is turned off, and, simultaneously, discharge signal 52 is turned on. When this happens, transistor 42 is turned off. This stops the charging of the area between diaphragm 5 and electrode 21. On the other hand, because transistor 45 is turned on, the electrical charge stored in the area between diaphragm 5 and electrode 21 is discharged in the direction of arrow B through resistor 46. Because discharge resistor is set considerably smaller than charge resistor 43 and its time constant during the discharge process is small, the discharge occurs in a shorter time, as shown in portion D of FIG. 8C, compared to the length of time required in the charging process. When the discharge occurs, diaphragm 5 is suddenly released from the electrostatic attraction. Because of its elasticity, diaphragm 5 returns to the standby position on its own accord, as shown in FIG. 9C, thereby pressing the ink ejection chamber 6 suddenly. The pressure generated inside ink ejection chamber 6 causes ink droplets 104 to squirt out from nozzle 4. During this process the displacement 54 of the meniscus 102 changes, as indicated in portion F of FIG. 8C. When the ejection pressure overcomes the viscosity and the surface tension of ink 103 that tend to pull the ink back into nozzle 4, the ink squirts out and attenuation vibrations ensue.

In FIG. 7, discharge resistor 47 has a sufficiently higher resistance value than charging resistor 43 or discharge resistor 46. While exerting little influence during the charging or discharging process when the head is operating, this discharge resistor 47 performs the function of gradually releasing any electrical charge that is stored initially in the area between diaphragm 5 and electrode 21 during the power-up stage. Discharge resistor 47 thus serves to keep the initial charge for the electrostatic actuator at the substantially zero level.

Figure 10:
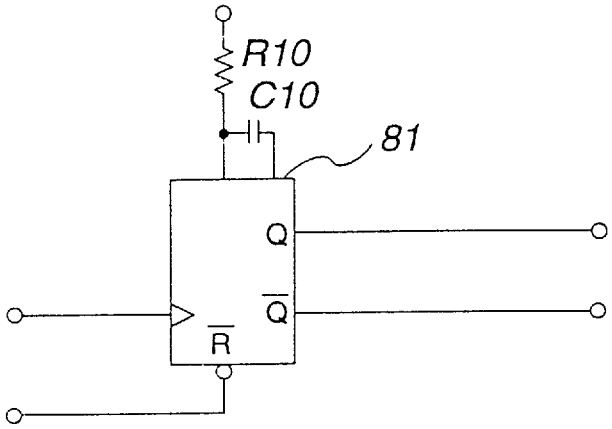
FIG. 10 is a circuit diagram showing an exemplary circuit for generating the timing pulses for the electrostatic actuator driving circuit of the present invention.

FIG. 10 shows an exemplary circuit for the timing pulse generation means in this embodiment. Of course, persons of ordinary skill in the art will recognize that various modifications and changes may be made therein. When the start-of-print signal S1 is input into a trigger input terminal for a mono-stable multivibrator 81, positive-phase pulses, whose time width is determined by external resistor R10 and the capacitor C10 combination time constant, are output as charge signals. Because in this embodiment the discharging process is commenced at the same time as the charging of the electrostatic actuator is stopped, pulses that are in opposite phase to the charge signal can be used as the discharge signal.

According to experiments, stable ink ejection was confirmed at a drive frequency of 3 kHz under the following conditions: 30V drive voltage, 15 $\mu$s charge time at 50Ω charge resistance; and 45 $\mu$s charge time at 5 KΩ charge resistance. At time $t_1$, if only charge signal 51 is turned off and discharge signal 52 is maintained at the off status, the displacement 54 of meniscus 102 undergoes attenuation vibrations as indicated by the broken lines in FIG. 8C. The period T of these attenuation vibrations is determined principally by the viscosity resistance of the ink channel, i.e., the viscosity of the ink. A published patent application (H2-24218) describes the fact that, in view of this phenomenon, by suctioning the ink for a time equal to ¼ (time t2) of the attenuation vibration cycle T, or for a time slightly longer than ¼ T, and by pressurizing the ink at the end of the suction process, it is possible to utilize the vibration energy of the ink system during the ink ejection process in order to achieve a high degree of drive efficiency and an ink ejection that requires only small electric power.

However, because in ink jet heads using an electrostatic actuator, if the drive voltage is set too high enough so that during a steady-state operation, diaphragm 5 may come into contact with the oppositely placed electrode 21. This contact may possibly damage the print hand or lead to unacceptable printing quality. Accordingly, it is desirable to compensate, adjust or stop the application of drive voltage before the diaphragm 5 actually touches electrode 21. This type of efficient drive is difficult to achieve, however, due to the fact that, when diaphragm 5 is about to touch the electrode, the vibration phase of the ink system always lags behind the diaphragm phase. The embodiments discussed hereinbelow achieve an efficient drive method in the timing pulse generation means to reduce the likelihood of this phenomena from occurring.

Second Embodiment

Figure 11:
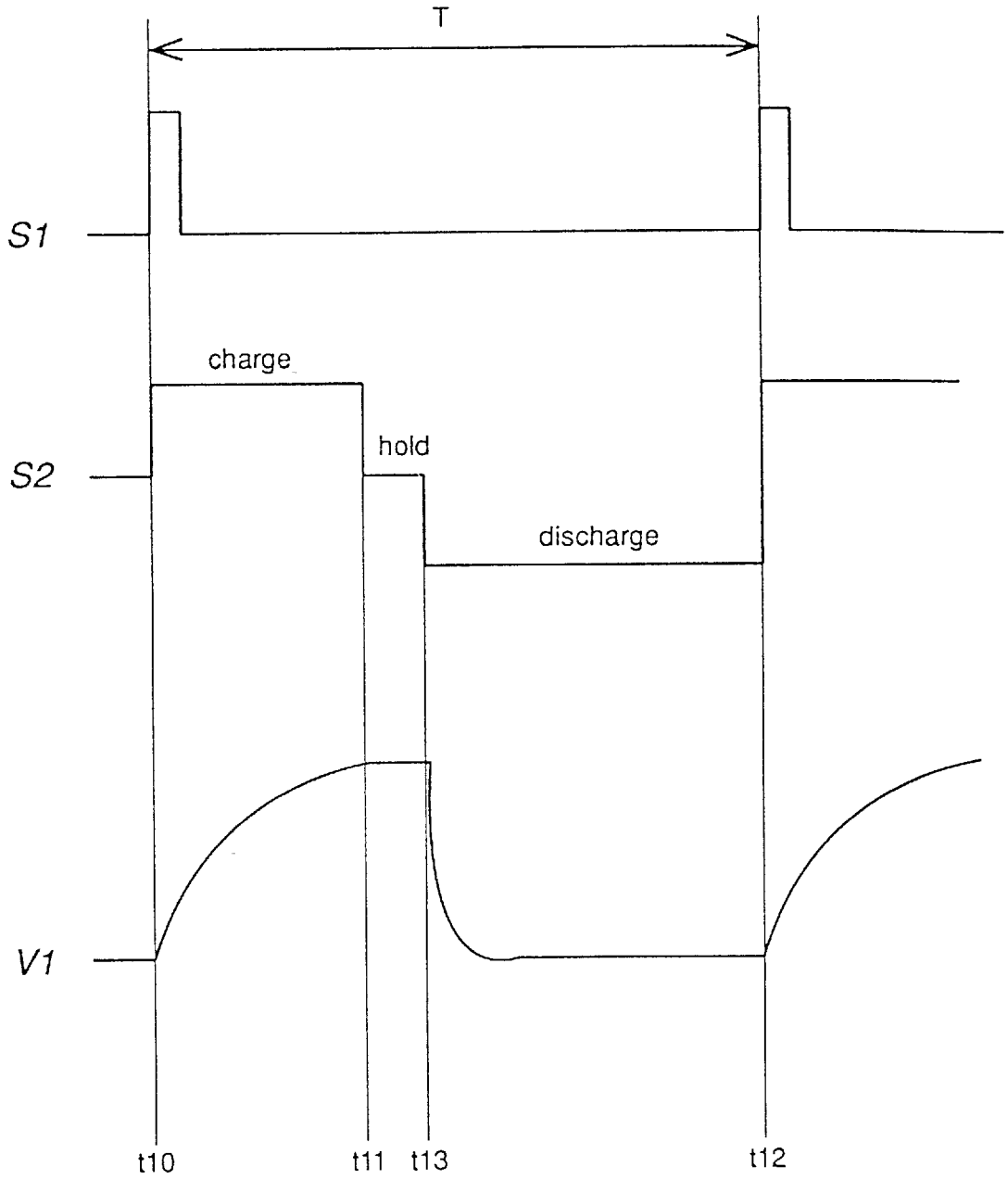
FIG. 11 is timing diagram of the input and driving signals in accordance with a second embodiment of the present invention.

FIG. 11 shows a timing chart indicating the drive method for an electrostatic actuator 27, in accordance with a second embodiment of the present invention. In FIG. 11 "S1" denotes the start-of-print signal, and "S2" indicates a model signal that depicts the states of charge signal 51 and discharge signal 52. In these states, the high level indicates a charge signal, the low level a discharge signal, and the medium level the hold status. Except for the provision of timing pulse generation means 63, the circuit configuration of the electrostatic actuator driver 40 is preferably substantially similar to that of the foregoing driver.

When start-of-print signal S1 is transmitted at time $t_{10}$ from the printer controller 62 to timing pulse generation means 63 of the electrostatic actuator driver 40 corresponding to the electrostatic actuator that performs the printing, timing pulse generation means 63 then sends charge signals to charge circuit 64. At time $t_{11}$, after a specified length of time necessary for ink suction to occur, the timing pulse generation means 63 stops the transmission of charge signals, places both the charge and discharge circuits in the idle state, and holds the electrostatic actuator 27. In other words, at this stage electrostatic actuator 27 is neither charged nor discharged. At time $t_{13}$, after a predetermined length of time necessary to allow the ink system to recover from a phase delay has elapsed, the timing pulse generation means 63 sends the discharge signal 52 to the discharge circuit 65 and thus begins to discharge the charge accumulated in electrostatic actuator 27.

This drive method, in which the charge state is held for a prescribed length of time after completion of the charging process before the discharging process is commenced, ensures an efficient ink ejection operation. The reason is that, in the vibrations of diaphragm 5 and of the ink system, the viscosity resistance of the ink channel and the viscosity of the ink causes phases of the ink system vibrations to lag to some extent behind phases of the vibrations of diaphragm 5. Therefore, after displacement of the diaphragm is stopped, without the diaphragm ever touching the electrode, the ink is pressurized when the vibrations of the ink system reach a maximum. This ensures effective utilization of the vibration energy of the ink system for the pumping of the ink.

Figure 12:
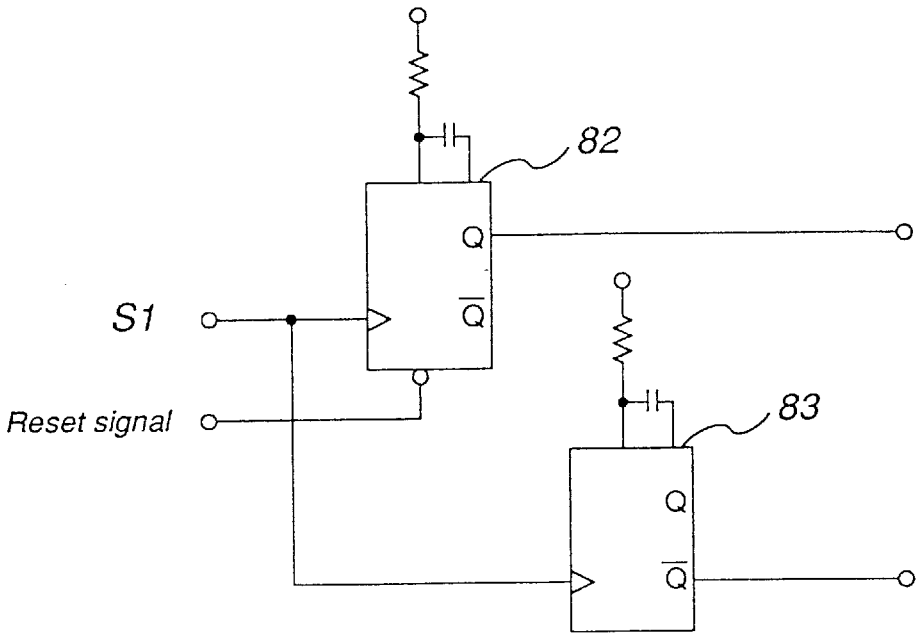
FIG. 12 is a schematic diagram of an exemplary circuit for implementing the driving signals in accordance with the second embodiment of the present invention.

FIG. 12 shows an exemplary circuit of a timing pulse generation means for the second embodiment. When the start-of-print signal S1 is input into the trigger input terminal of a first mono-stable multivibrator 82, charge pulses, whose time duration is determined by resistor $R_{12\text{-}1}$ and capacitor $C_{12\text{-}1}$, are output as positive-phase signals. At the same time, the start-of-print signal S1 is similarly input into a second mono-stable multivibrator 83, and discharge signals, whose time duration is determined by resistor $R_{12\text{-}2}$ and capacitor $C_{12\text{-}2}$, are output from the opposite-phase or complement output terminal to discharge circuit 65. In this circuit configuration the pulse width of the pulses generated by the first mono-stable multivibrator 82 is set in such a way that it is shorter than the pulse width of the pulses generated by second mono-stable multivibrator 83 by the length of the hold time.

Figure 13:
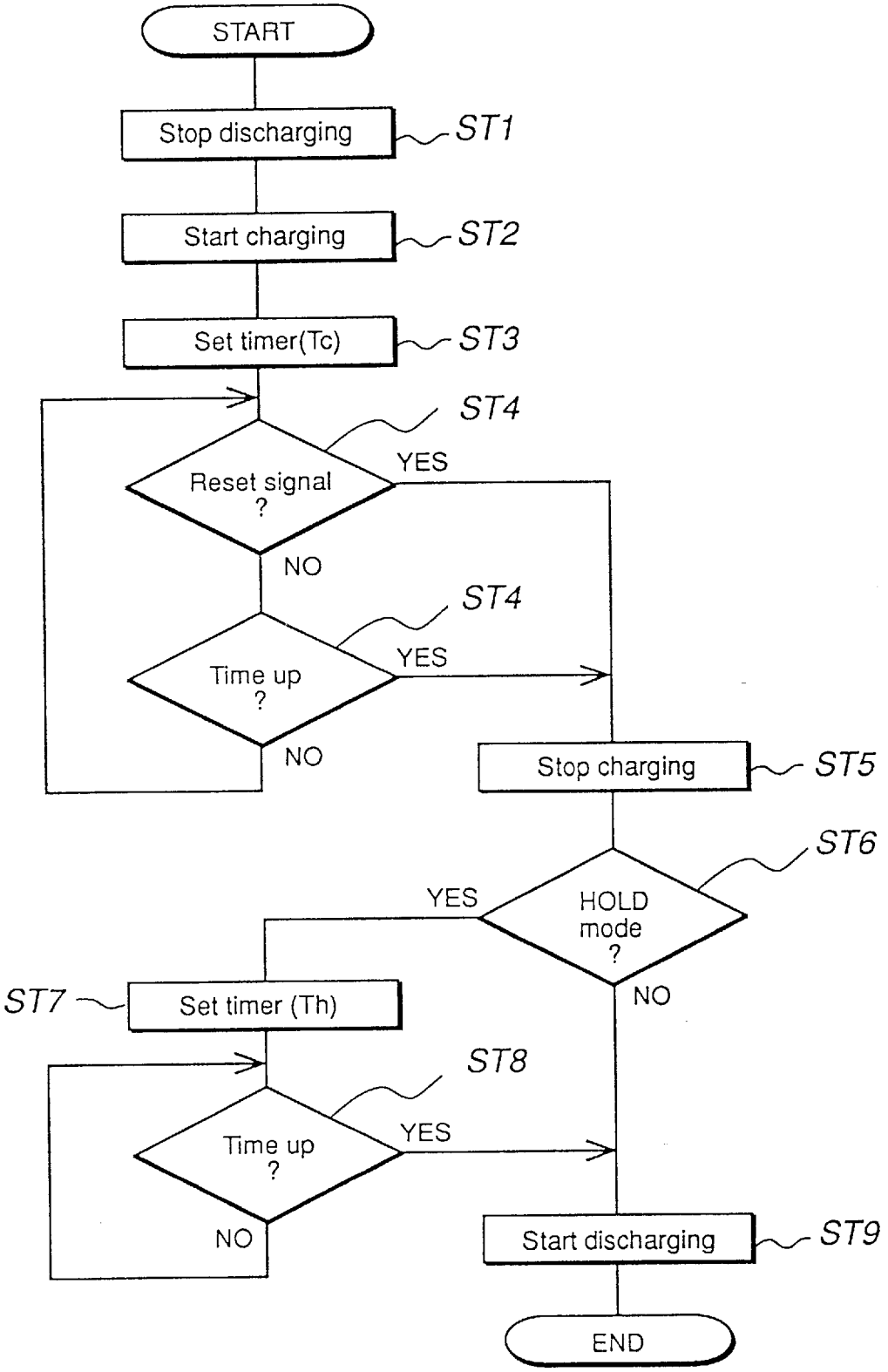
FIG. 13 is a flow chart for driving the electrostatic actuator in accordance with the second embodiment of the present invention.

FIG. 13 illustrates a flow chart where the second embodiment is an implementation utilizing a programmed processor such as a general purpose computer, a microprocessor or the like (not shown). In this embodiment, a provision is made to allow the user to select whether to utilize the hold time in accordance, for example, with the type of printer. The following is a description of how the timing pulse generation means operates. When receiving the start-of-print signal S1, the processor sets the discharge signal in the inactive state at ST1, sets the charge signal in the active state at ST2, and begins charging the electrostatic actuator 27. At ST3, the microprocessor sets the charge time Tc, at ST4 the microprocessor circuit detects the time-up condition for this timer, and at ST5 the circuit stops charging while putting the charge signal in the inactive state. In doing so, at ST6 the microprocessor determines, for example based on printer specifications, whether or not the hold status is to be set. If the printer requires the hold status, the microprocessor sets hold time Th in the timer and maintains the hold status until such time as a time-up condition is detected at ST8. After a time-up condition is detected, or if the printer does not require the setting of the hold status, the microprocessor circuit initiates the discharging process by setting the discharge signal 52 in the active state at ST9.

Note that in the timing chart of the present embodiment shown in FIG. 11, signal S2 representing the charge or discharge state clearly shows that the discharge state is maintained during the period from the discharge to the start of succeeding charge, namely from $t_{14}$ to $t_{12}$. As a result, inter-terminal impedance of the electrostatic actuator is maintained fairly low, thus preventing the electrostatic actuator from operating improperly under the influence of the external noise or induction noise.

Third Embodiment

Although, in the above embodiment, the power supply voltage used for the charging of the electrostatic actuator is regulated not to fluctuate, in actual printers the power supply voltage may fluctuate, both initially and dynamically due to a variety of causes. In such cases, the charge conditions must be modified, as explained below.

Figure 14:
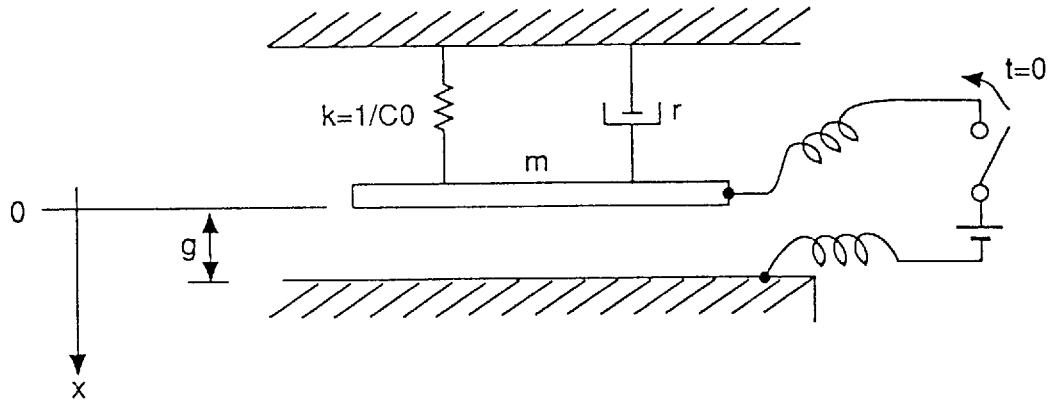
FIG. 14 illustrates a simplified equivalent model for determining the displacement characteristics of the electrostatic actuator.

FIG. 14 shows a simplified model for determining the displacement of the diaphragm for the electrostatic actuator, where m denotes the sum of ink inertias and the mass of the diaphragm, r is the ink's channel resistance, $C_0$ is the diaphragm compliance, e is the permittivity, $V_a$ is the voltage applied to the space between the diaphragm and the electrode, G is the gap between the diaphragm and the electrode, and x is the displacement of the diaphragm. Based upon this model, the following motion equations, can be obtained:

$$mx''+rx'+(1/C0)x=e/2(V_a/(G-x))^2 \tag{3}$$

$$x(0)=x'(0)=0$$

and $$V_a=V_s\cdot e^{1-t/RC} \tag{4}$$

where $V_s$ denotes the power supply voltage used for charging, R is the resistance of charge resistor 43 and C is the electrostatic capacity of the electrostatic actuator.

Figure 15:
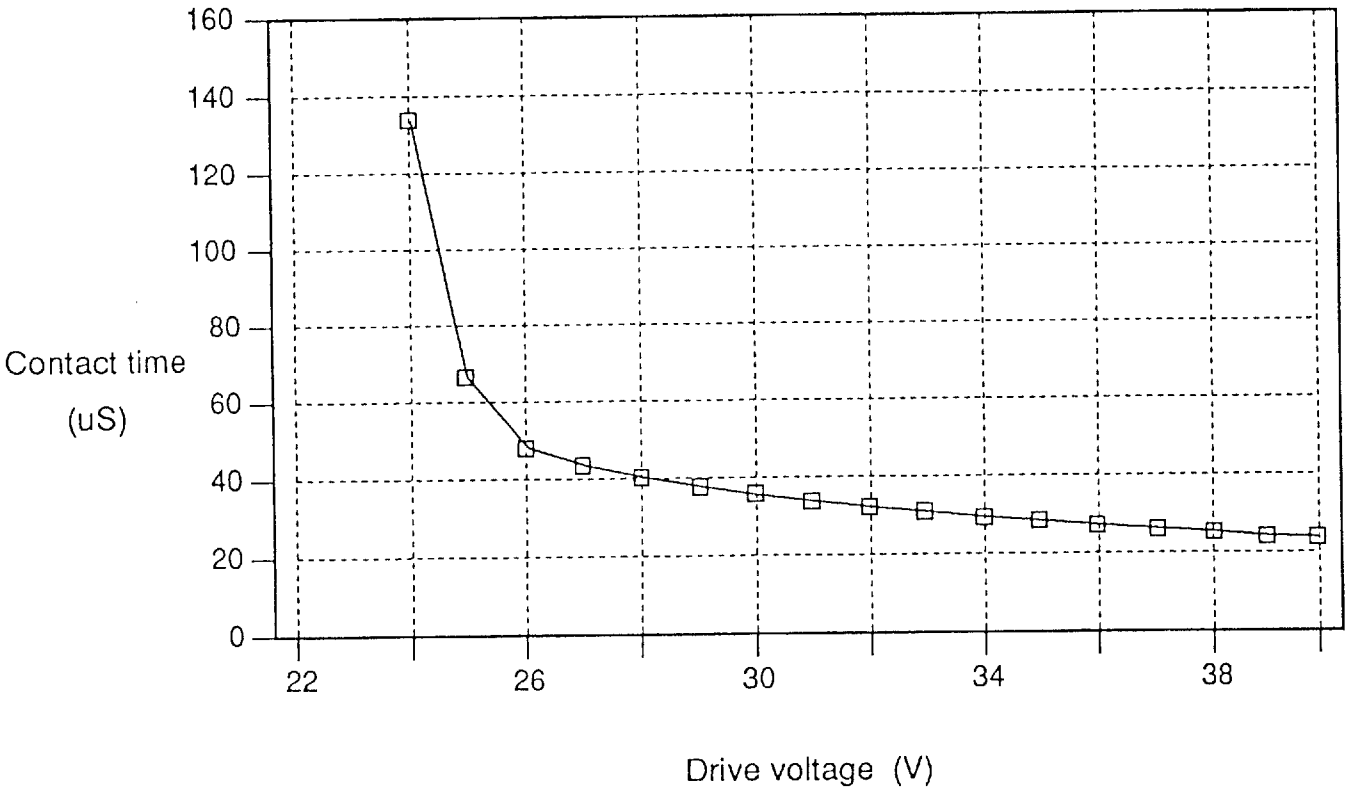
FIG. 15 is a graph illustrating the relationship between the driving voltage applied to the electrostatic actuator and the diaphragm-electrode contact time.

As indicated in Equations (3) and (4), the displacement x of diaphragm 5 is a function of the power supply voltage $V_s$, and, consequently, contact time, during which diaphragm 5 is in contact with electrode 21. The displacement also varies with the power supply voltage $V_s$. FIG. 15 shows an example of the relationship between power supply voltage and contact time. In this example the constants enumerated above have the following values:

$m=1.0\times10^{8}$ [kg/m]

$r=1.5\times10^{12}$ [N.x/m]

$C0=2.5\times10^{-18}$ [$m^5$/N]

R=3.9 [K ohm]

According to FIG. 15, in the neighborhood of a 30 V drive voltage, normally the contact time varies at a rate of 2 $\mu$s per volt. Therefore, to prevent any contact, the charge time must be varied according to the power supply voltage by varying the charge conditions such as the charge resistance value or the charge time.

This and the following embodiments are produced in light of the aforementioned requirements.

Figure 16:
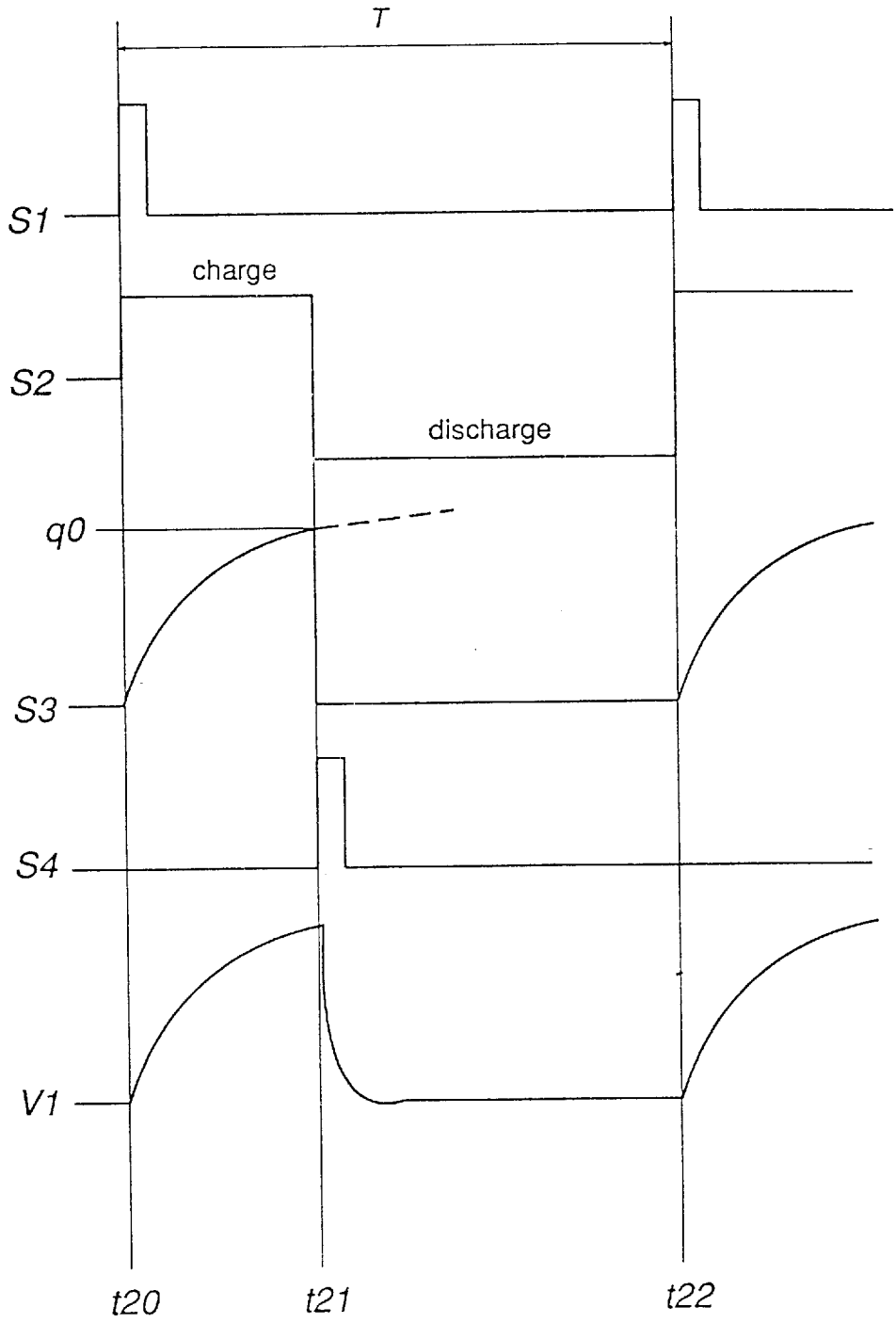
FIG. 16 is timing diagram of the input and driving signals in accordance with a third embodiment of the present invention.
Figure 17:
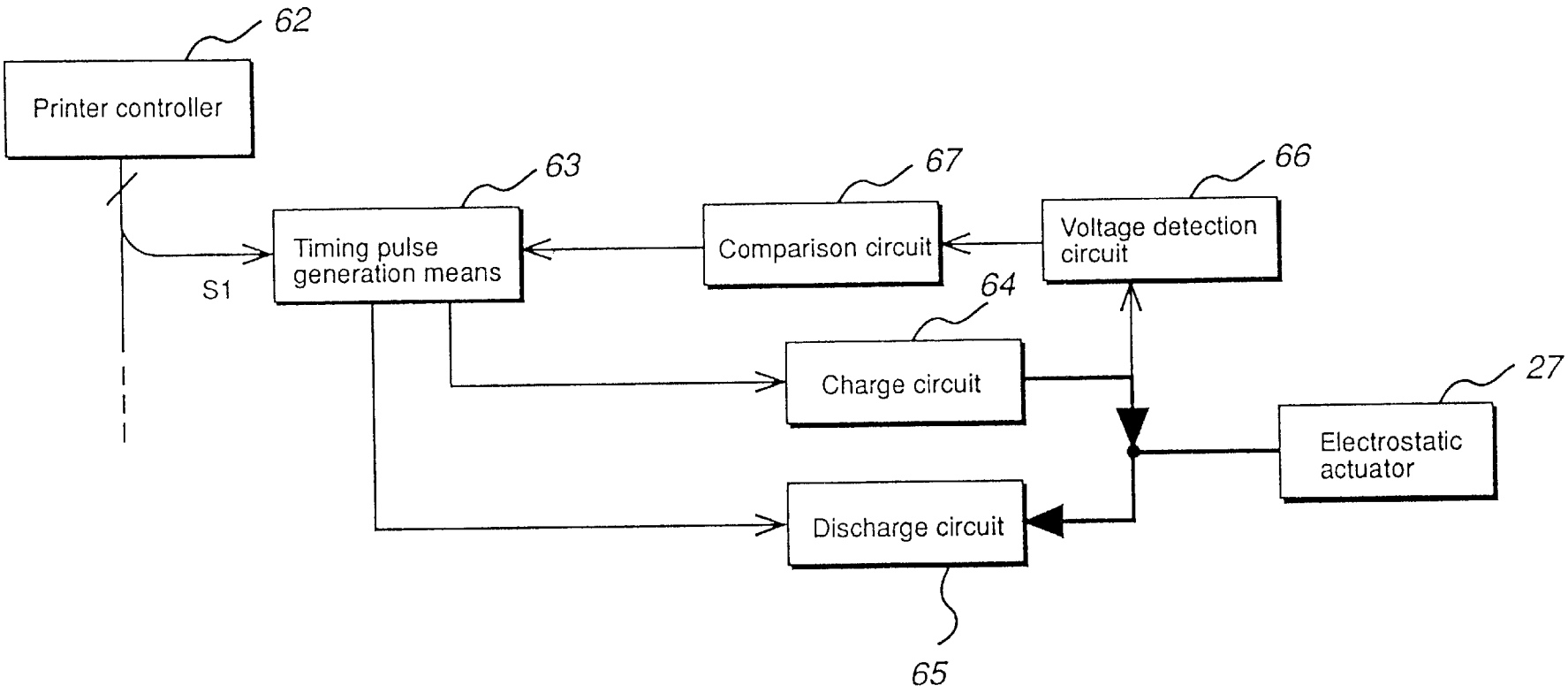
FIG. 17 is a block diagram for the electrostatic actuator driving circuit in accordance with the third embodiment of the present invention.

FIG. 17 is a block diagram that shows the ink jet head driver used in the third embodiment of the present invention. FIG. 16 is a timing chart showing the ink jet head drive method for the present embodiment.

When the start-of-print signal S1 is transmitted from printer controller 62 to timing pulse generation means 63 at time $t_{20}$, timing pulse generation means 63 transmits a charge signal 51 to charge circuit 64 and begins charging electrostatic actuator 27. Comparison circuit 67 compares the inter-terminal voltage of the electrostatic actuator 27, detected by voltage detection circuit 66, with a voltage value corresponding to a specified charge amount, $q_0$. When the amount of charge built up in electrostatic actuator 27 reaches the specified value $q_0$ at time $t_{21}$, comparison circuit 67 provides a reset signal S4 to timing pulse generation means 63. This causes timing pulse generation means 63 to set charge signal 51 in the inactive state and stop the charging of electrostatic actuator 27. The operations that occur after this point are the same as those described in the first and second embodiments above and need not be further discussed.

Figure 18:
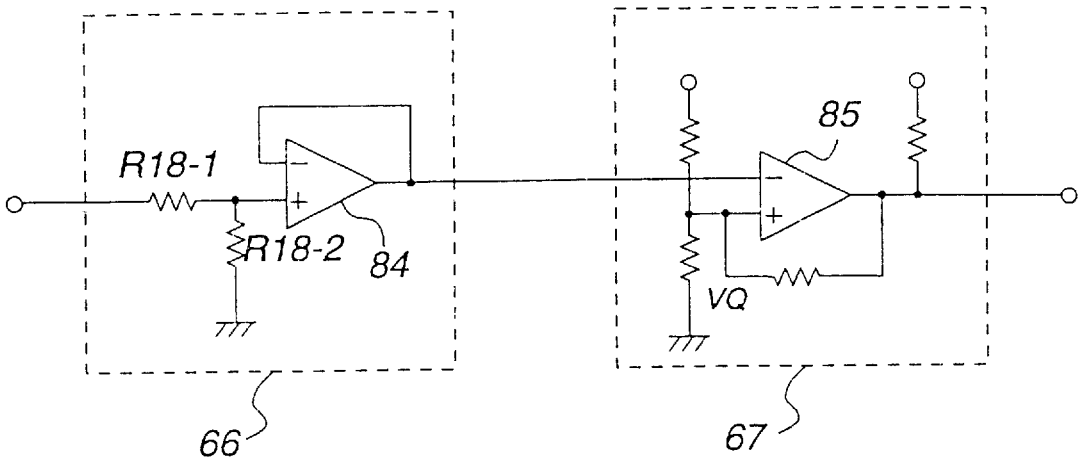
FIG. 18 illustrates an exemplary voltage detection circuit and comparison circuit for the electrostatic actuator driving circuit in accordance with the third embodiment of the present invention.

FIG. 18 depicts voltage detection circuit 66 and an exemplary comparison circuit 67 that can be used in the present embodiment. The inter-terminal voltage of electrostatic actuator 27, after undergoing a voltage division through, for example, a resistance bridge comprising resistors $R_{18-1}$ and $R_{18-2}$, is input into a comparator 85 through a voltage follower circuit 84. In comparator 85, the inter-terminal voltage is compared with the voltage value corresponding to the charge quantity $q_0$. If the comparison indicates that the charge voltage is less than a specified value, comparator 85 outputs a low-level reset signal to timing pulse generation means 63. In the example circuit for timing pulse generation means 63, shown in FIGS. 10 and 12, the reset signal is input into the reset terminal of mono-stable multi-vibrators 81 and 82, thus causing charge signal 51 to assume the inactive state. In the example, timing pulse generation means implemented by a processor, shown in FIG. 13, the presence or absence of a reset signal is tested at ST4. If a reset signal is present, the charge process is immediately halted.

Figure 34:
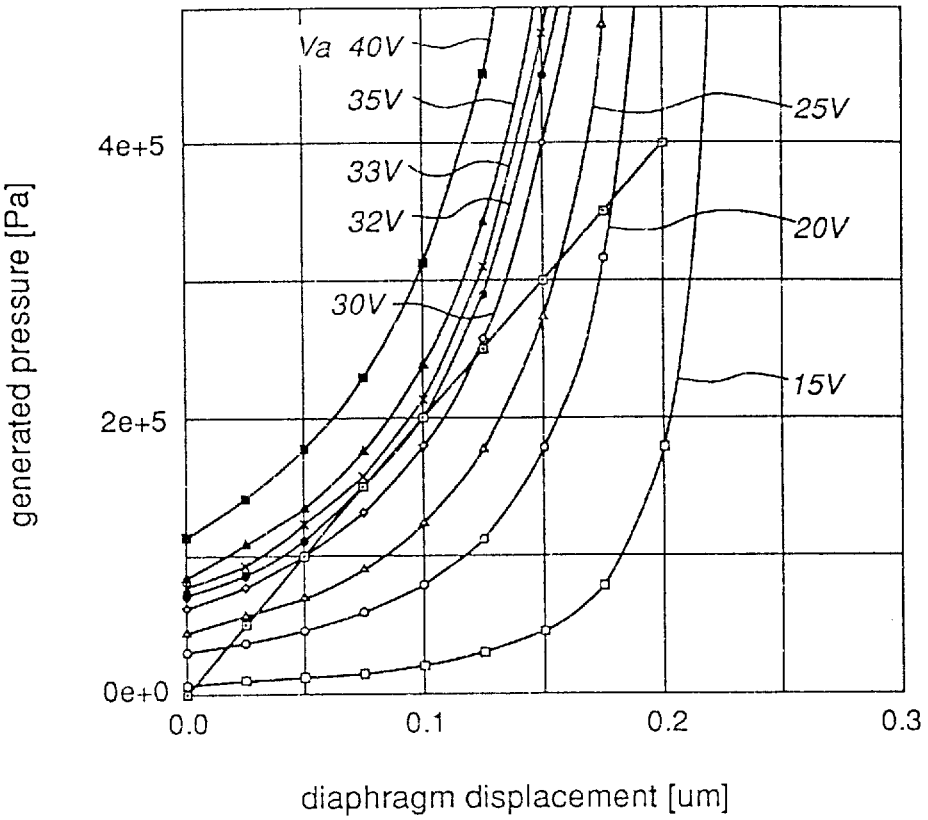
FIG. 34 is a graph illustrating the relationship between diaphragm displacement, electrostatic attraction, and the restoring force of the diaphragm.
Figure 35:
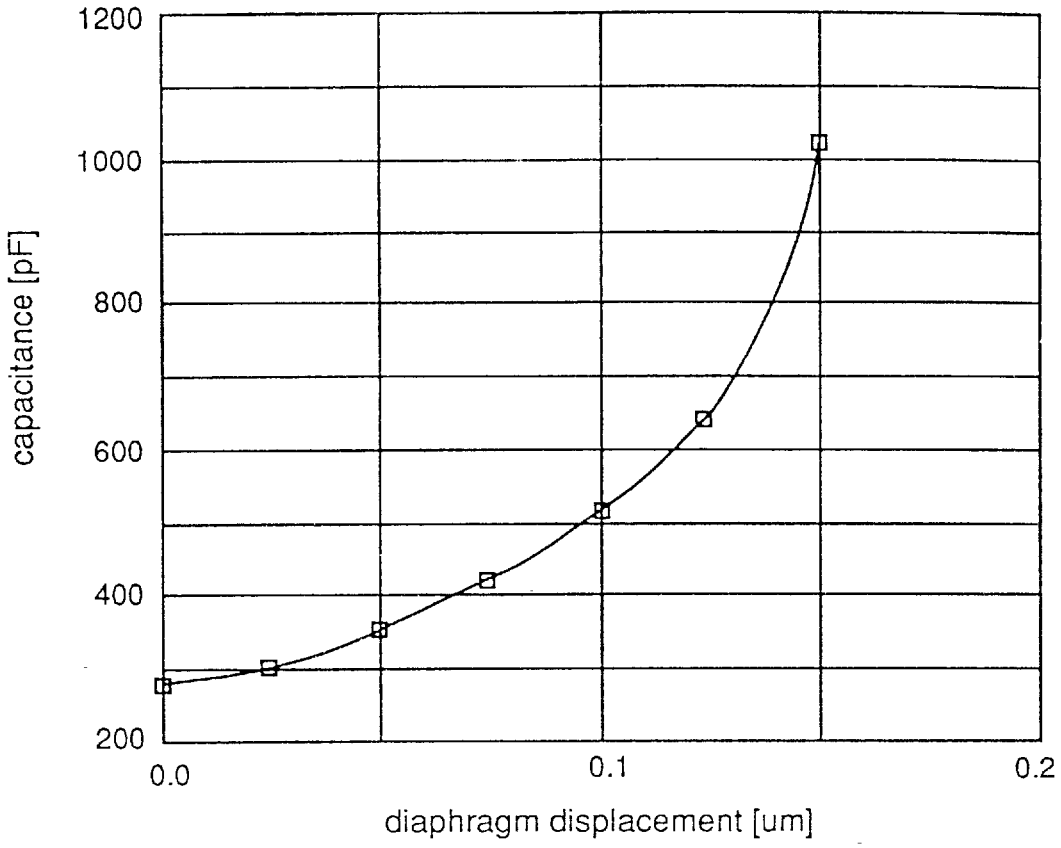
FIG. 35 is a graph illustrating the relationship between diaphragm displacement and the electrostatic capacity of the actuator.

As noted above and shown in FIG. 34, inter-terminal voltages and diaphragm displacements are in a one-to-one correspondence, and thus a given diaphragm displacement can be derived uniquely from an inter-terminal voltage. Further, as shown in FIG. 35, the relationship between the inter-terminal voltage and the electric charge can be determined uniquely by the amount of displacement of the diaphragm. Therefore, according to the above configuration, the charge pulses are regulated, not in terms of time, but in terms of inter-terminal voltages which are in a one-to-one correspondence with the charge amounts. This permits an accurate determination, generally all times, of the amount of displacement that diaphragm 5 may undergo. By virtue of this feature, it is possible to reduce the influence of variation in the value of charge resistance 43 or the fluctuations in the value of the drive voltage. This results in an even more stable ink ejection and a higher quality output.

Further, as will be appreciated by one of ordinary skill in the art, the efficiency of ink ejection can be enhanced, as noted above, by providing a specified hold time before the discharge signal is put into the active state.

Fourth Embodiment

Figure 19:
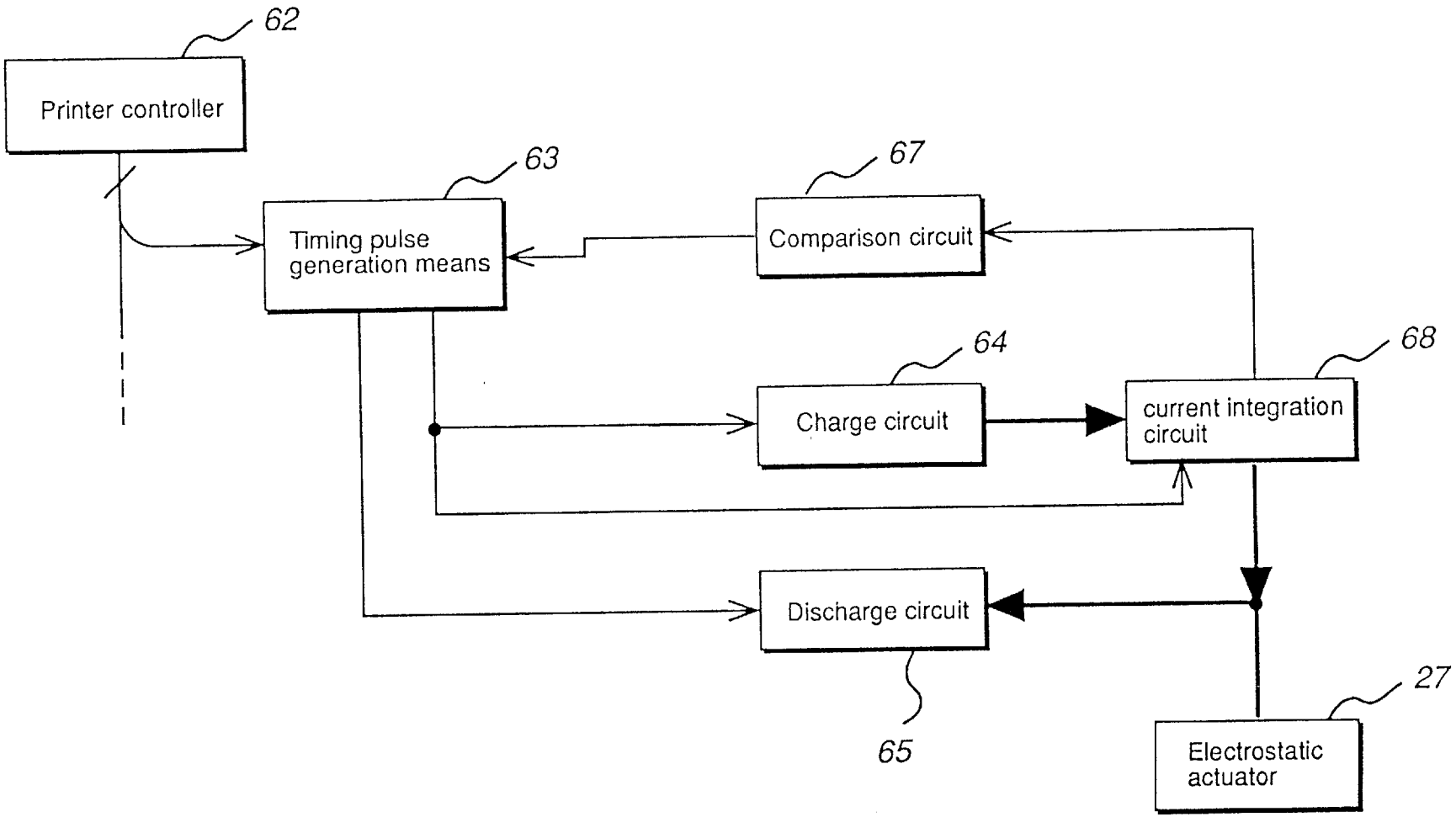
FIG. 19 is a block diagram for the electrostatic actuator driving circuit in accordance with a fourth embodiment of the present invention.

In the fourth embodiment, a means of measuring the amount of charge that has accumulated in the electrostatic actuator is provided for detecting the integrated value of the charge current instead of the inter-terminal voltage of the electrostatic actuator. FIG. 19 shows a block diagram of this type of configuration. At time $t_{20}$ (FIG. 16), timing pulse generation means 63 sets charge signal 51 in the active state and simultaneously transmits a reset signal to current integration circuit 68. Upon receiving this signal, charge circuit 64 begins charging electrostatic actuator 27 and current integration circuit 68 begins the integration of the charge current flowing to electrostatic actuator 27. The integrated value of the charge current, i.e., the amount of charge, is compared in comparison circuit 67 with a specified charge quantity, $q_0$, thus causing the generation of a reset signal. The operations that occur subsequent to this step are identical to those described in the third embodiment based on a voltage detection.

Figure 20:
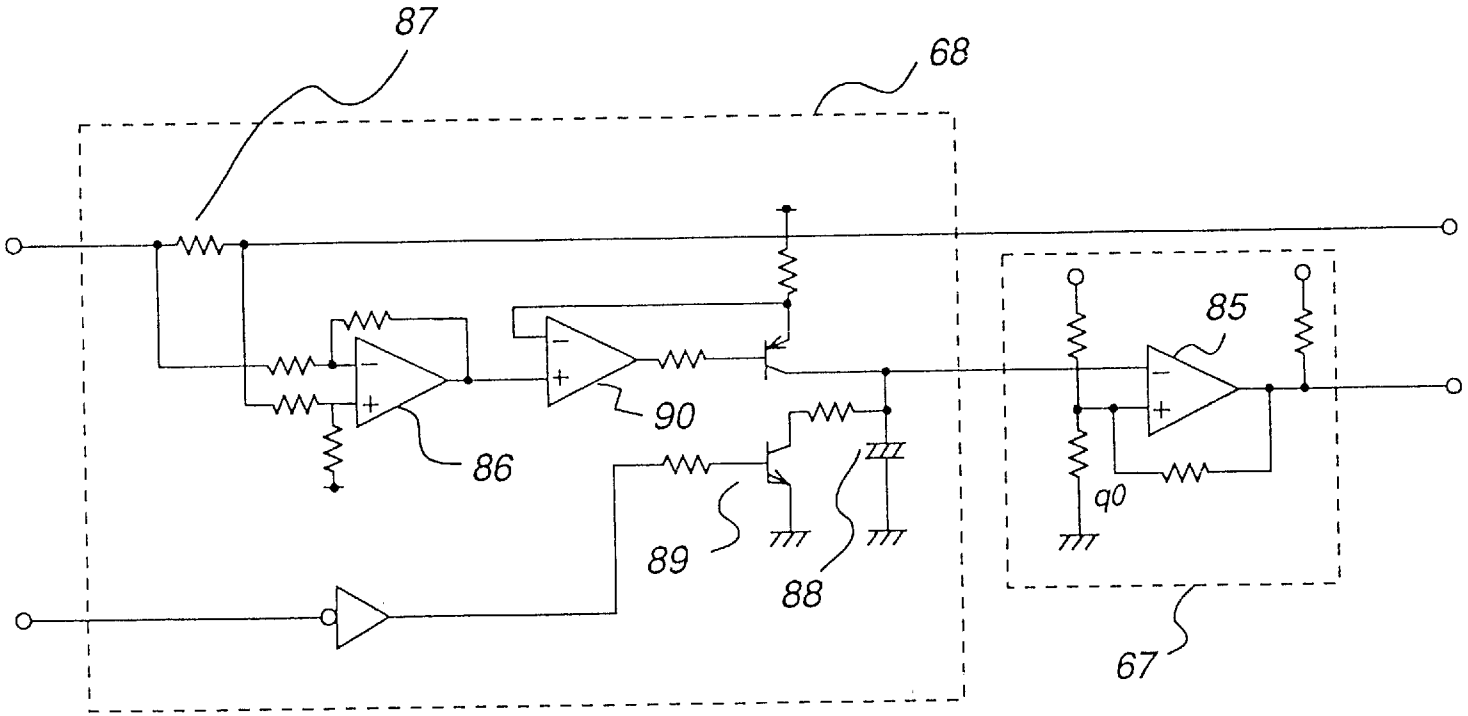
FIG. 20 illustrates an exemplary current integration circuit and comparison circuit for the electrostatic actuator driving circuit in accordance with the fourth embodiment of the present invention.

FIG. 20 shows an exemplary circuit example of current integration circuit 68. A voltage proportional to the current which is generated by current detection resistor 87, which is provided in the charge path, is converted to a current value by operational amplifier 86 and the constant-current driver 90. The integrated value is stored in capacitor 88. Capacitor 88 is discharged when the discharge transistor 89 is turned on by a reset signal transmitted from timing pulse generation means 63. The current, proportional to the charge current that is integrated by capacitor 88, is compared by comparison circuit 67 with a specified value. A reset signal is output when the integrated current is sent to the timing pulse generation circuit.

Fifth Embodiment

In third and fourth embodiment, either voltage detection circuit 66 directly detects the charge state of the electrostatic actuator 27, or current integration circuit 68 detects the charge stored in electrostatic actuator 27. However, these circuits elements increase the complexity of the driver circuit. To prevent this problem, the fifth embodiment is organized in such a way that an optimal charge time for a drive voltage, such as the power supply voltage, is predetermined and charge time is modified based upon the information obtained from a means of measuring the drive voltage.

Figure 21:
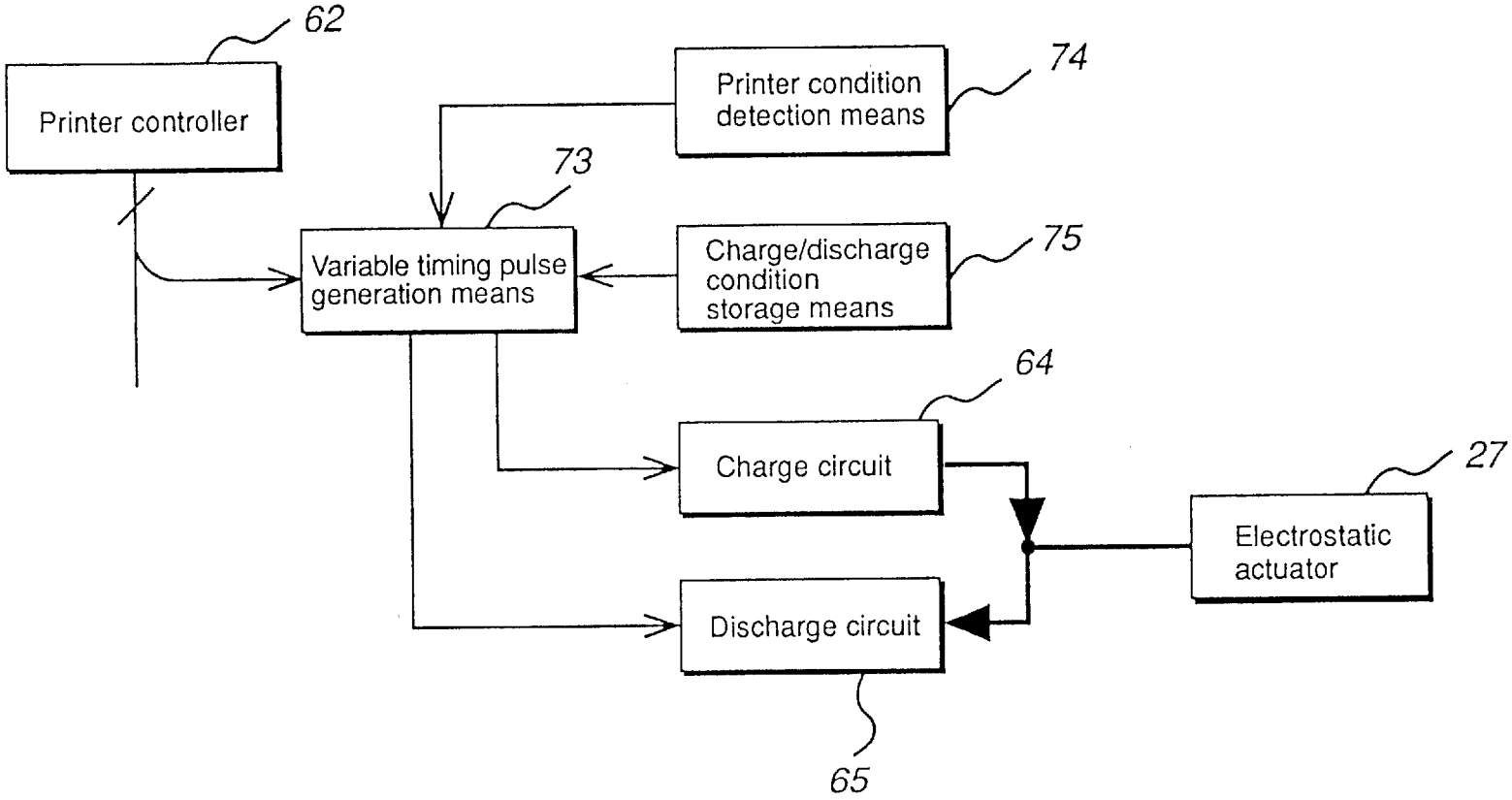
FIG. 21 is a block diagram for the electrostatic actuator driving circuit in accordance with a fifth embodiment of the present invention.

FIG. 21 shows a block diagram of the electrostatic actuator driver under the present embodiment. When the start-of-print signal S1 is output from printer controller 62, variable timing pulse generation means 73 reads information on the condition of the printer from the printer condition detection means 74, which detects printer conditions, such as power supply voltage, ambient temperature, ambient humidity on the amount of time the printer has been operating, ambient air pressure, age of the ink and the ink pressure in the channel. As will be appreciated by those of ordinary skill in the art, these factors and other factors not enumerated above may affect the electrostatic actuator of the present invention. It will be noted, that the other factors may be detected by appropriate detection means. Temperature can be detected by various known temperature sensors and the ambient air pressure can be detected by various known air pressure sensors. Accordingly, the discussion of these sensors is omitted. Examples of pressure transducers for ink jet heads are discussed in U.S. Pat. Nos. 4,744,863, 4,996,082 4,853,669, 5,189,777, and 3,918,019. The contents of these patents are incorporated herein by reference. In accordance with the detected condition(s), the variable timing pulse generation means 73 receives an optimal charge time for the current printer condition from charge condition memory means 75. Subsequently, variable timing pulse generation means 73 charges and discharges the electrostatic actuator as described in the first embodiment. The charge condition memory means is capable of producing not only charge time but also an appropriate hold time. The following is a detailed explanation with reference to actual circuit examples.

Figure 22:
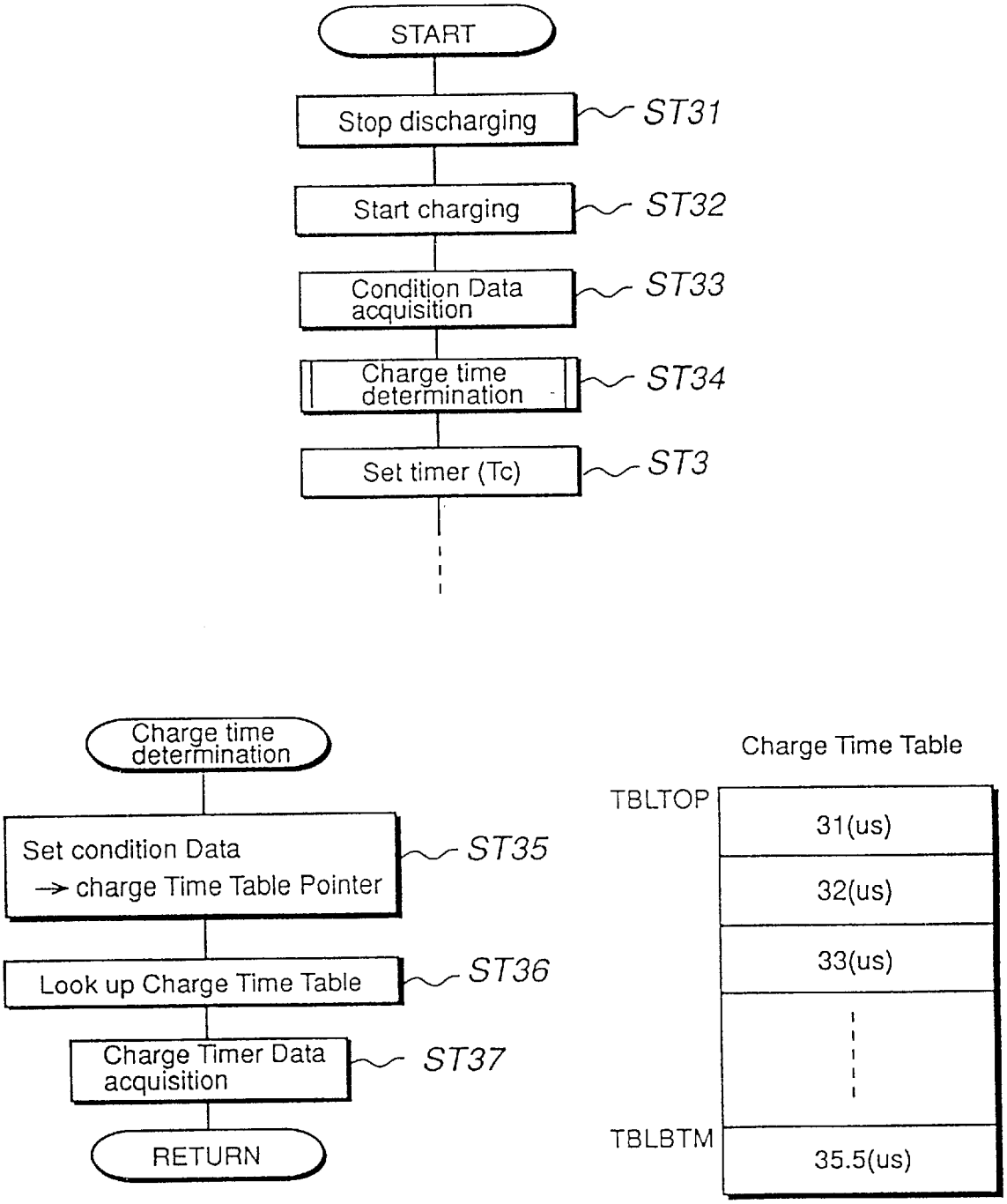
FIG. 22 is a flow chart illustrating a variable timing pulse generation means and a charge condition storage means for the electrostatic actuator driver of the fifth embodiment.

FIG. 22 is a flowchart describing the sequence of operations that occur when variable timing pulse generation means 73 is implemented using a processor.

After receiving the start-of-print signal S1, the processor stops the discharging process at ST31, and simultaneously begins the charging process at ST32. At ST33, the processor receives information on printer conditions and status data from printer condition detection means or recording apparatus condition determination circuit 74. In this example the "printer condition" refers to the voltage for the drive power supply section. Of course, the printer condition can be any combination of printer conditions enumerated above. At ST34, the microprocessor starts up the subroutine for determining the length of charge time. At ST35, the subroutine assigns the status data to the pointer to a charge time table, and, at ST36, the subroutine references the table. At ST37, the subroutine reads charge time data from the table and passes the data to the main routine. Based on the charge time data, the main routine performs a series of processing tasks such as setting the timer. The operations that occur after this step are identical to those described in first and second embodiments 1. If hold time must be changed according to the condition that the printer is in, all that needs to be done is to set up a hold time table and to perform the same processing tasks as in the case of setting a hold time. Thus it suffices to pass the status data to the pointer to the hold time table.

Figure 23:
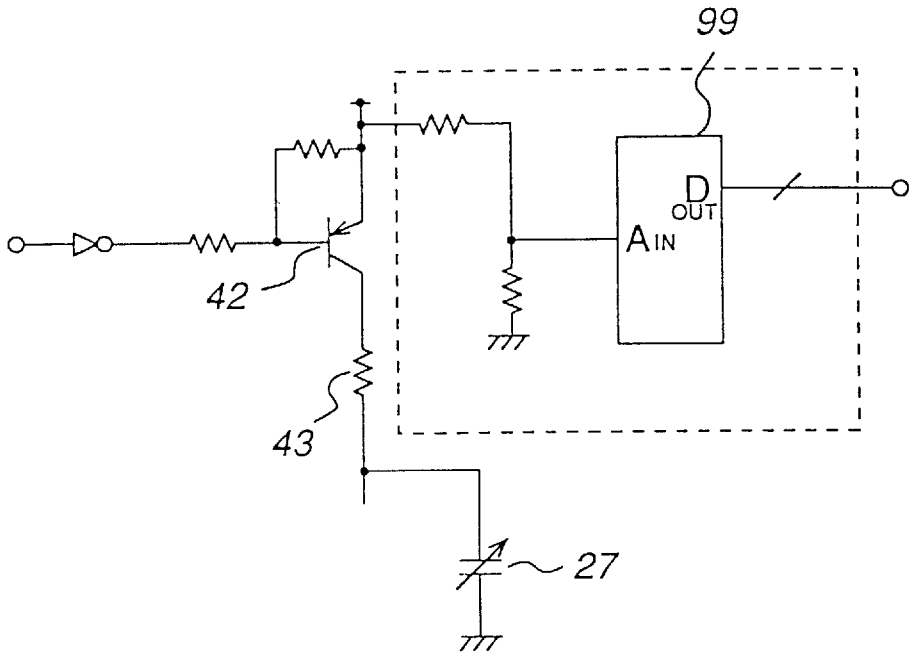
FIG. 23 illustrates an exemplary printer condition detection circuit for the electrostatic actuator driver of the present invention.

FIG. 23 is an exemplary circuit that detects the drive voltage for the electrostatic actuator. The circuit comprises an amplifier comprising transistor 42, resistor 43 and capacitor 27. The amplified voltage signal is converted to a digital signal by analog-to-digital (A/O) converter 99. The operation of this circuit is apparent to one of ordinary skill in the art and will not be discussed.

Sixth Embodiment

In embodiments 1 through 5 above the value of the charge resistance is a critical factor that influences the print quality of electrostatic actuator-based ink jet heads. The following explains the reason for this fact and describes a method for setting a charge resistance value.

Figure 24:
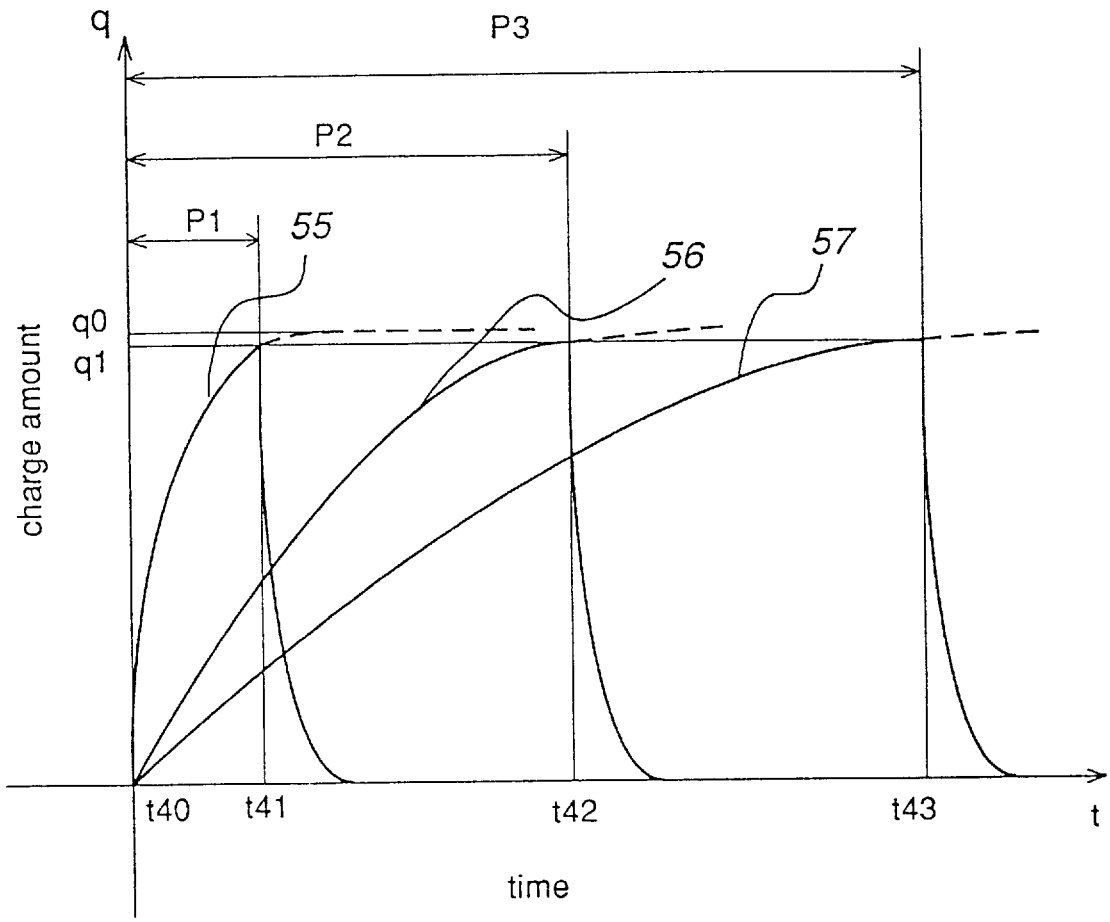
FIG. 24 illustrates the change in the amount of electrical charge between the electrode (21) and the diaphragm (5) when the ink jet head is charged, relative to the charge resistance value of the ink jet printer in accordance with a sixth embodiment of the present invention.

FIG. 24 is a graph showing change in the amount of electrical charge between electrode 21 and diaphragm 5 during the charging process. In the charge circuit shown in FIG. 7, if the value of charge resistance 43 is small, which determines the time constant during the charging process, the amount of electrical charge changes as indicated by solid line 91. If the value of charge resistance 43 is large, the change in the amount of electrical charge varies according to solid line 93.

If change in the amount of electrical charge varies gradually, as shown in solid line 93, the electrical charge necessary for ink suction cannot be obtained at time t41. Consequently, the change in the volume of ink ejection chamber 6 is not sufficient to produce a large enough ink ejection. If ink ejection is forced under these conditions, a significant degradation in print quality or even no ink ejection at all will result. To obtain a sufficient amount of electrical charge, the charge pulse width must be increased to time $t_{43}$. This, however, decreases the responsiveness of the head and results in a failure to obtain the desired printing speed. According to experimental and computational verifications, a sufficient amount of ink suction occurs if the amount of electrical charge stored is approximately 90% of the capacity of the capacitor composed of diaphragm 5 and electrode 21. Therefore, the ratio between the time constant (RC) for the charge circuit, composed of the charge resistance and the electrostatic actuator capacitance, and the charge time ($T_0$), as determined from Equation (5), providing Equation (6), for the determination of the maximum charge resistance value.

$$q=q_0(1-\exp(-T_0/RC)) \quad (5)$$

$$q>=0.9q_0$$

$$T_0/RC>=2.3 \quad (6)$$

RC<=0.43T0

Figure 25:
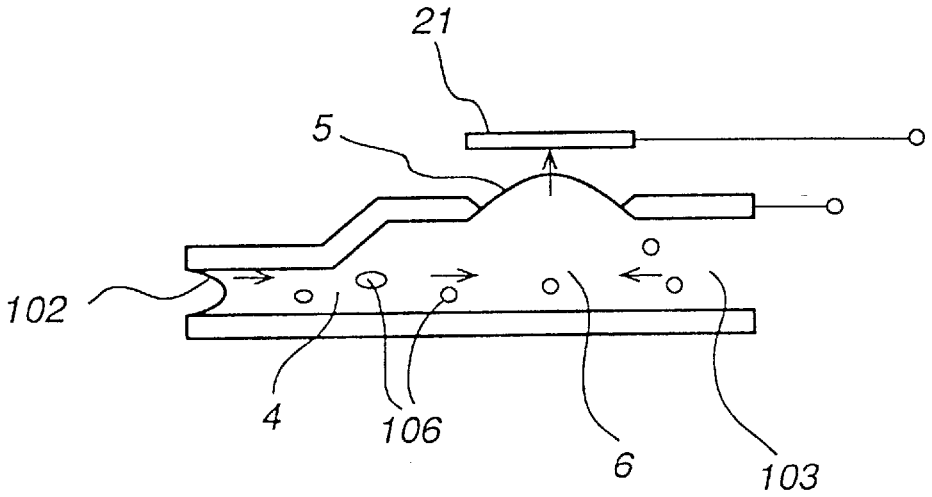
FIG. 25 is a lateral cross-sectional view of the ink jet head in which bubbles are formed therein.

On the other hand, when the change in the amount of electrical charge varies rapidly, as shown in line 91, the ink in the ink channel is attracted suddenly to the vicinity of the diaphragm, as indicated in FIG. 25. Any attempt to suction the ink under these conditions causes either the formation of air bubbles 106 from the nozzle connected to the ink channel due to a pressure (negative pressure) that is lower than the atmospheric pressure or the occurrence of nitrogen and other gases dissolved in the ink as air bubbles 106 due to the rapid vibrations of the ink in the ink channel. As discussed previously, even if the electrical charge stored in the area between the diaphragm and the electrode is released under these conditions so as to reset the volume of the ink channel to the standby status, the pressure that would normally push out the generated ink has a tendency to be absorbed by the bubbles 106, thus leading to a phenomenon of a reduced amount of or even no ink ejection. To prevent this problem it is also necessary to establish a lower limit on the time constant for the charge circuit. According to experimental verifications, even when a non-bubbling ink is used by removing the nitrogen and other gases contained in the ink channel by degassing, the application of negative pressure, greater than $2\times10^5$ pascal, generates bubbles in the ink channel, thus preventing any ejection of ink.

When an experiment was conducted under the conditions of 30 V applied to the head, a charge time value $T_0$ of 15 $\mu$sec, and a resistance of 50 ohm for the resistor 43, no bubbles occurred and a stable ink ejection was obtained in the ink jet head. A measurement of the capacitor comprised by electrode 21 and diaphragm 5 gave an approximate time constant of 0.0135 $\mu$sec at approximately 270 pF.

Therefore, the ink jet drive method of the present invention ensures a stable ink ejection by regulating the value of the charge resistor 43 in such a way that the upper limit on the time constant for the charge circuit is less than ½ of the charge pulse width and the lower limit on the negative pressure exerted on the ink during the suctioning of the ink is less than $2\times10^5$ pascal.

Seventh Embodiment

Figure 26:
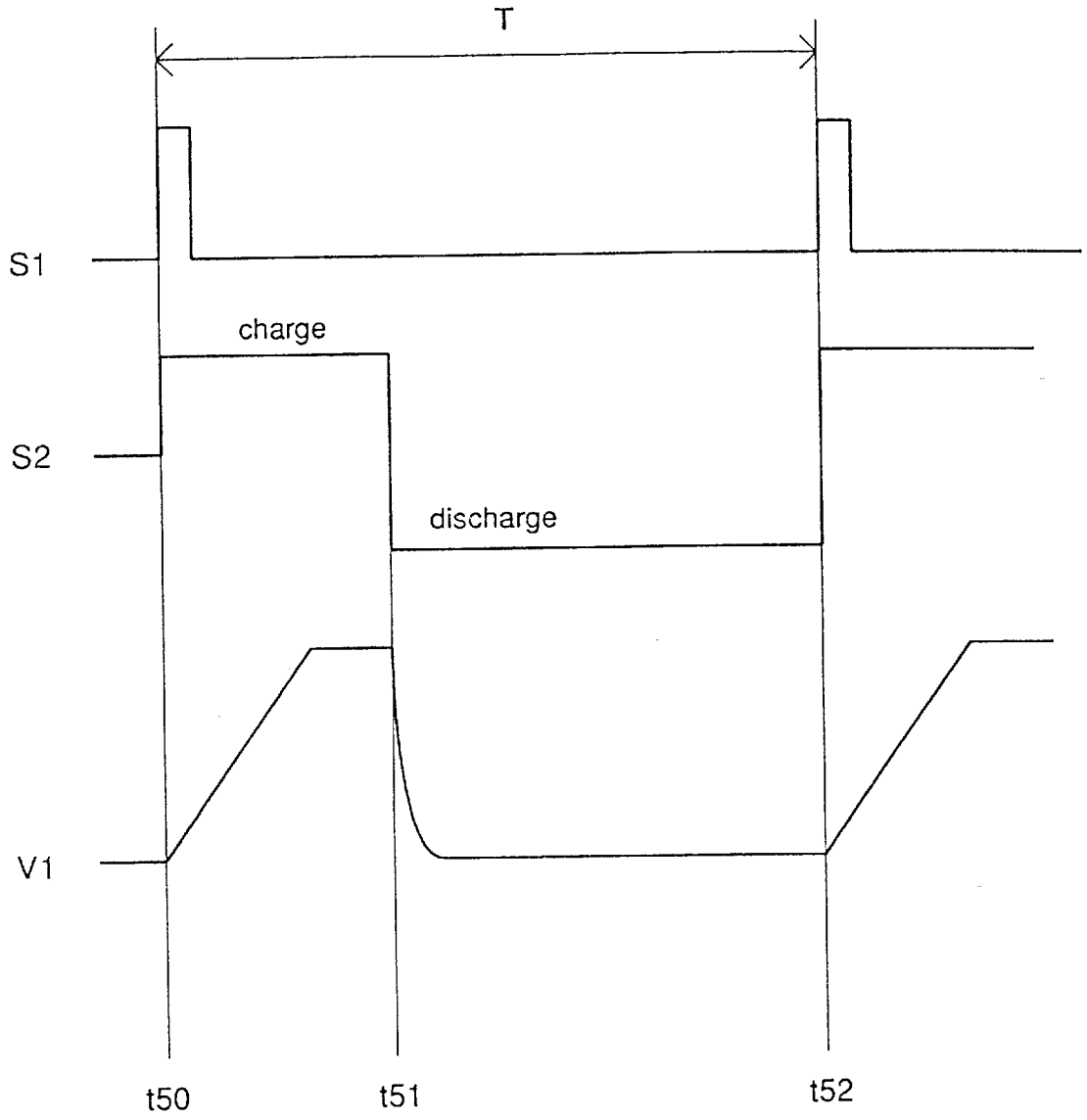
FIG. 26 is timing diagram of the input and driving signals in accordance with a seventh embodiment of the present invention.
Figure 27:
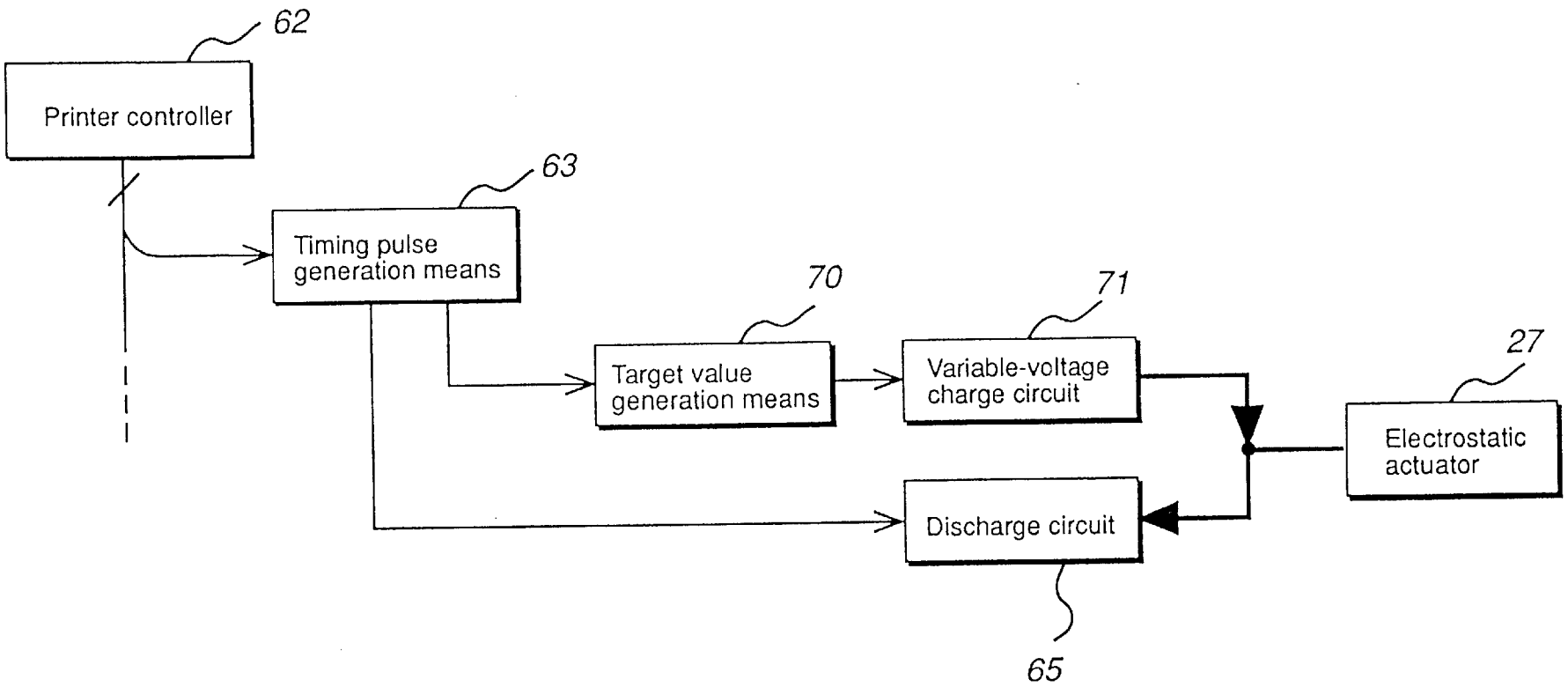
FIG. 27 is a block diagram for the electrostatic actuator driving circuit in accordance with the seventh embodiment of the present invention.

FIG. 27 is a block diagram that shows the ink jet head drive circuit used in the seventh embodiment of the present invention. FIG. 26 is a timing chart showing the ink jet head drive in accordance with the seventh embodiment. These examples are applied to serial printers as shown in FIG. 33.

The following is an explanation of the composition and operation of the present embodiment with reference to FIGS. 26 and 27.

A characteristic of this embodiment is that a variable voltage charge circuit 71 is used as a charge circuit to charge electrostatic actuator 27 and that a target value generation means 70 is provided for generating a target charge voltage value to the variable voltage charge circuit according to the length of time that has elapsed since the charging process began. When printer controller 62 moves the carriage to a specified print position, the printer controller transmits the start-of-print signal S1 at time $t_{50}$ to one or more electrostatic actuator drivers 40 that correspond to the dots to be printed. Upon receiving the start-of-print signal S1, timing pulse generation means 63, transmits an activation signal to target value generation means 70. As mentioned above, target value generation means 70 generates a target voltage, as shown in FIG. 26, according to the length of time that has elapsed since it received the activation time and provides the generated target voltage to variable voltage charge circuit 71. Upon receiving this voltage, variable voltage charge circuit 71 outputs the charge voltage, equal to target value, to the electrostatic actuator 70.

When the activation signal from the timing pulse generation means 63 becomes inactive at time $t_{51}$, target value generation means 70 stops generating target values, and variable voltage charge circuit 71 stops charging electrostatic actuator 27. After that the electrostatic actuator performs discharging actions as previously described in the first and second embodiments.

Figure 28:
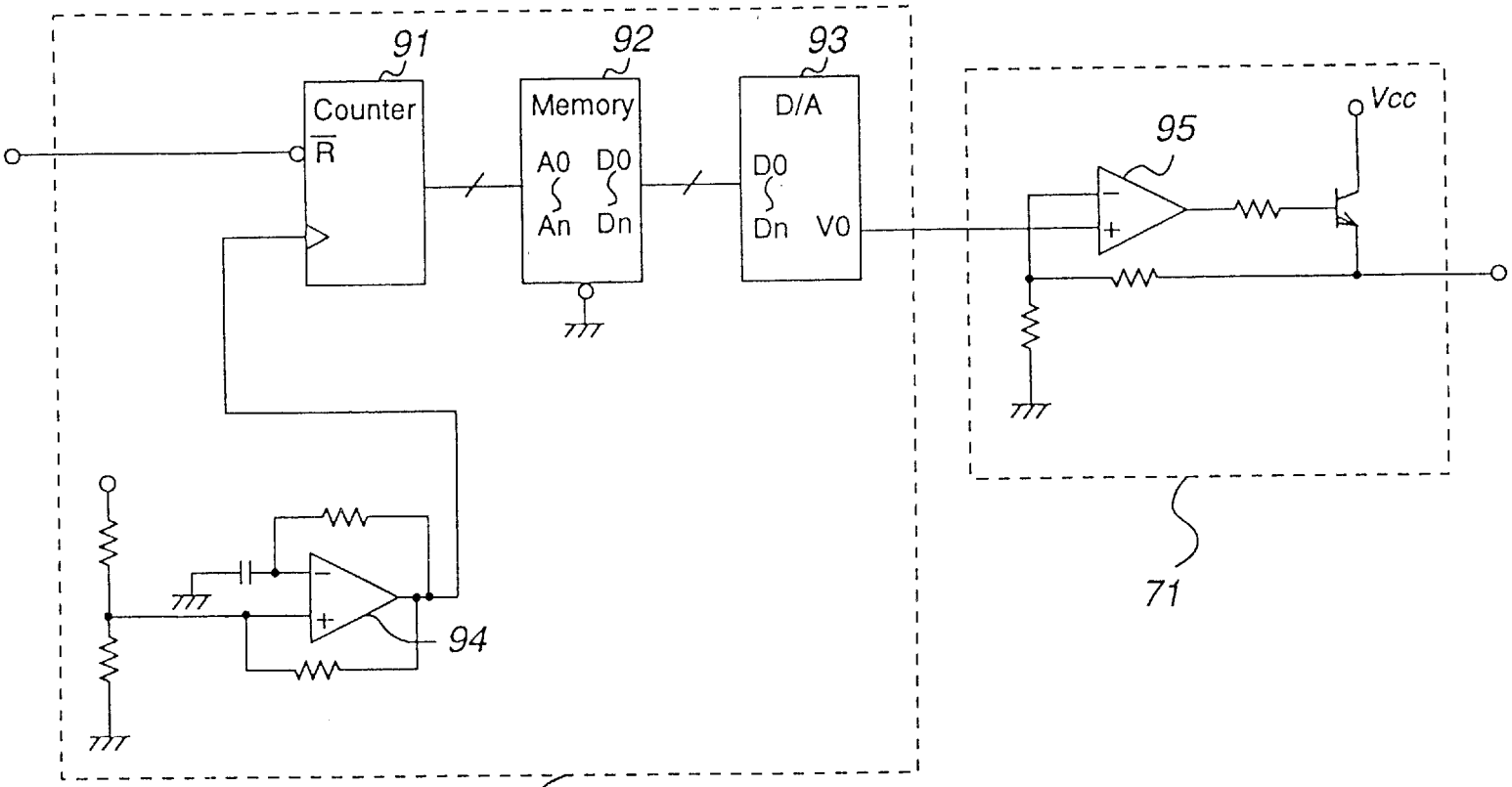
FIG. 28 illustrates an exemplary target value generation circuit means and variable-voltage charge circuit for the electrostatic actuator driver of the seventh embodiment of the present invention.

FIG. 28 shows exemplary circuits of target value generation means 70 and variable voltage charge circuit 71 in accordance with the seventh embodiment. The activation signal from timing pulse generation means 63 is connected to the reset input section of counter 91. When the activation signal becomes active, counter 91 begins operating, i.e., starts counting the clock signals that are supplied by transmission circuit 94. The count output from counter 91 is a binary output and is input into the address input section of memory 92 in which target value data are stored. Therefore, the addresses in the memory are updated at every predetermined clock count as received from transmission circuit 94, and the target value data stored at the addresses are supplied to the digital input section of digital to analog D/A converter 93. Then, a target value is output from the D/A converter 93 as a voltage. When the activation signal becomes inactive, the counter 91 is reset. When this occurs, the target value data stored at address 00H of the memory 92 are input into the digital input section of the D/A converter. Therefore, the charging of the electrostatic actuator can be stopped by storing at this address a data value that forces the charge voltage to be 0.

The variable voltage charge circuit 71 is a constant-voltage driver comprising a feedback loop for attenuating voltages. Thus, the variable voltage charge circuit is capable of producing output voltages that are proportional to the target voltages generated by the D/A converter 93.

Figure 29:
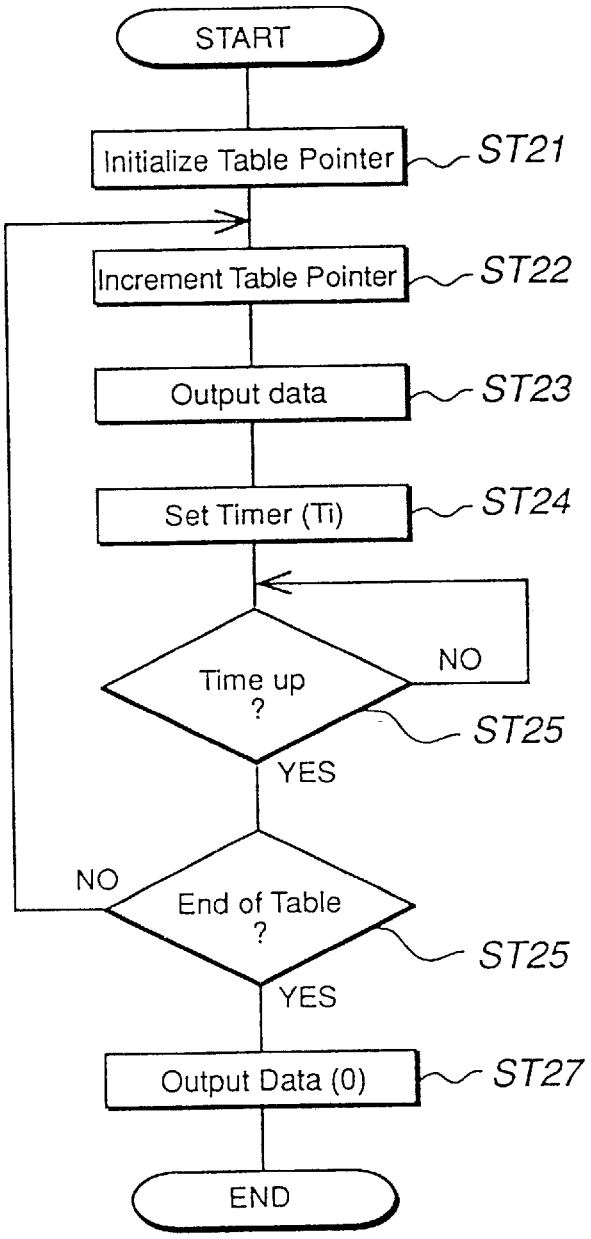
FIG. 29 is a flow chart of the target value generation circuit for the electrostatic actuator driver of the seventh embodiment of the present invention.

FIG. 29 is another example of the target value generation means 70 implemented by a computer or processor (not shown). When, at time $t_{50}$, the start-of-print signal S1 is output from printer controller 62 and an activation signal is output by timing pulse generation means 63, at ST21 the microprocessor initializes the address pointer to the table in which target value data are stored. At ST22, the microprocessor updates the address, at ST23, the microprocessor reads the data stored at that address from the table, and outputs data to the D/A converter. Then, at ST24, the microprocessor sets in the timer a specified time interval ($T_i$) in which the target value can be updated. At ST25, the microprocessor waits until the time-up condition occurs. After the time-up condition is detected, at ST26, the microprocessor checks whether or not the end of data in the target value table was reached. If there are still other data, the microprocessor loops to ST22 and outputs the next target value. If the end of data has been reached, at ST27, the microprocessor outputs the data that set the charge voltage to 0 and thus terminates the generation of target values.

Eighth Embodiment

Figure 30:
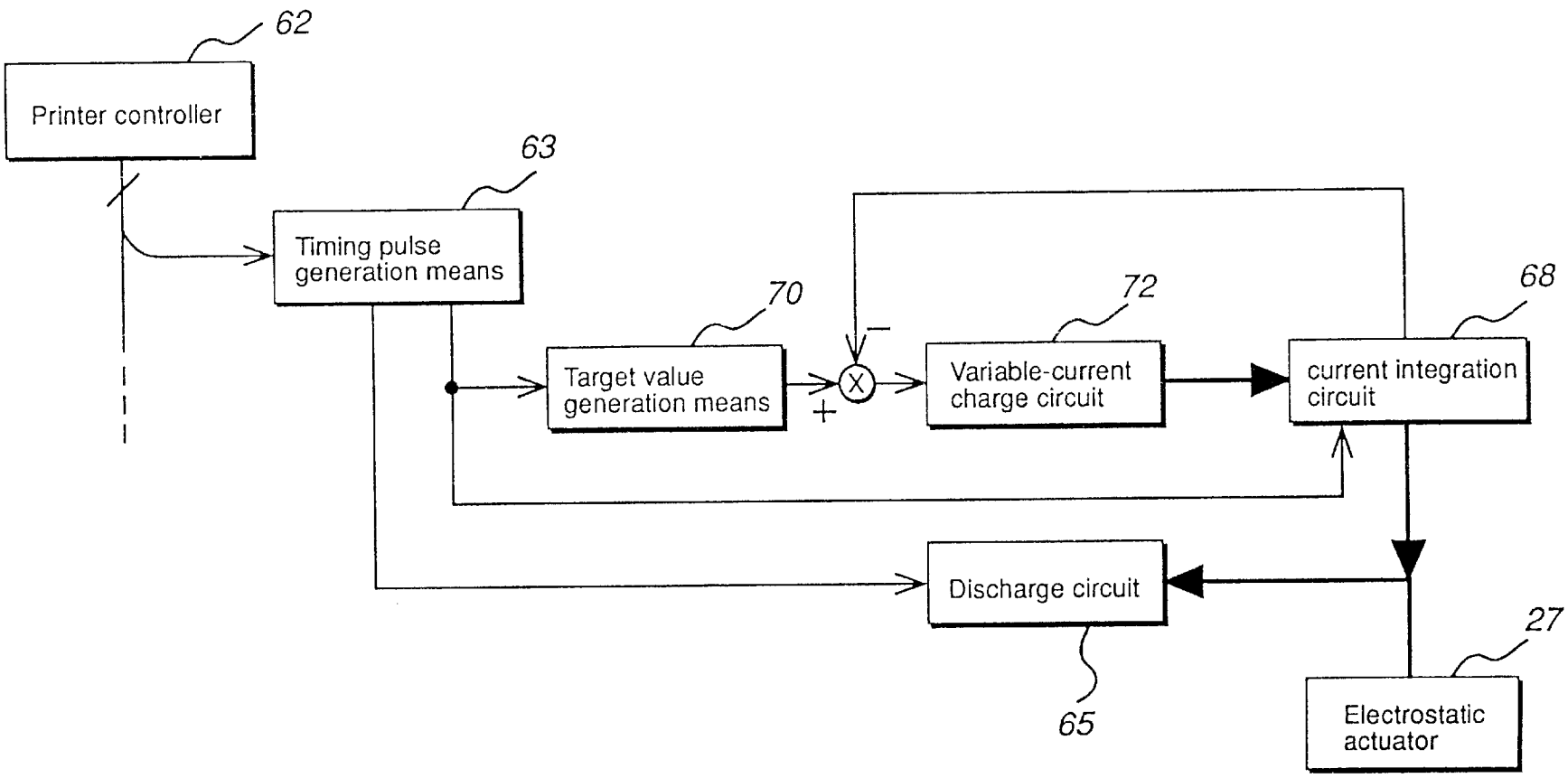
FIG. 30 is a block diagram for the electrostatic actuator driving circuit in accordance with a eighth embodiment of the present invention.

FIG. 30 depicts the eighth embodiment of the present invention, a variation of the seventh embodiment. In this eighth embodiment a target charge amount is generated instead of a target charge voltage for the electrostatic actuator, and the amount of charging, commensurate with the elapsed time since the beginning of the charging process, done by the electrostatic actuator is regulated by supplying the charge current equal to the difference between the target charge amount and the integration of the charge current.

Target value generation means 70 directly uses either the above circuit examples or a processor control sequence. When timing pulse generation means 63 outputs an activation signal to target value generation means 20, target value generation means 70, as noted above, generates a target charge quantity corresponding to the elapsed time. On the other hand, current integration circuit 68, described in detail in the fourth embodiment, initiates the integration of the charge current after receiving an activation signal from timing pulse generation means 63 and feeds back the output from the integration process as a command charge current value for variable current charge circuit 72. Thus, the difference between the target charge quantity given by target value generation means 70 and the amount of current charged in the electrostatic actuator 40 and feedback from current integration circuit 72 becomes the command current value for variable current charge circuit 72. In this manner, the amount of charge stored in the electrostatic actuator 40 is always regulated so that it is equal to the target value from target value generation means 70.

Figure 31:
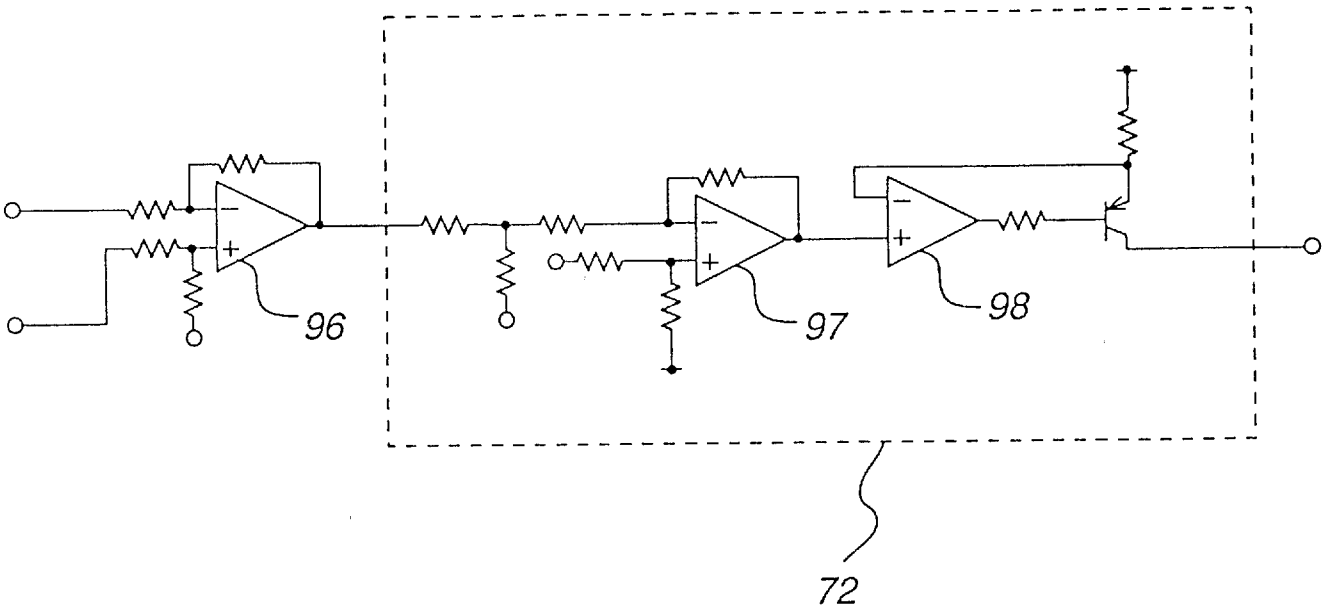
FIG. 31 illustrates an exemplary variable-voltage charge circuit for the electrostatic actuator driver of the eighth embodiment of the present invention.

FIG. 31 shows a circuit example of variable current charge circuit 72. The command current value, obtained by the differential amplifier 96 as a difference between the target value and the integrated current value, is level-shifted by level converter 97 after being attenuated and is input into constant-current driver 98. In this manner a charge current corresponding to the command current value can be obtained.

In the eighth embodiment, the contents of either memory 92 or the target value table containing target values are set so that, during the ink suctioning process, the negative pressure exerted on the ink is no greater than $2\times10^5$ pascal. As such the amount of electrical charge necessary to cause ink suction for ink ejection is stored in the area between electrode 21 and diaphragm 5.

In this manner, by providing a feedback control on the amount of charge stored in the area between electrode 21 and diaphragm 5, the amount of charge ultimately stored between electrode 21 and diaphragm 5 can be regulated so that diaphragm 5 does not touch electrode 21. Accordingly, the amount of charge necessary to cause that level of suction that ensures adequate ink ejection is stored, an optimal gap is constantly maintained, and a stable ink ejection is achieved.

Ninth Embodiment

Although the above embodiments assumes that the electromechanical properties of the electrostatic actuator, the ink viscosity, and other properties are constant, in reality these properties vary between production lots and are subject to change due to aging or temperature. Therefore, charge time and target values are set in consideration of these factors and of values that tend to err on the side of safety rather than optimal values. As mentioned above, in an ink jet head based on the electrostatic actuator method, the distance between the diaphragm and the electrode must be controlled so that the distance is minimized as much as possible without the diaphragm and the electrode ever touching each other. However, setting safe values means that the closest distance between the diaphragm and the electrode is kept relatively large at the expense of drive efficiency and print quality. Further, even though a direct contact is prevented, the fact that the smallest distance can vary leads to uneven print quality, for example, the density of the print. Therefore, improvements are needed in these areas from a practical standpoint.

Figure 32:
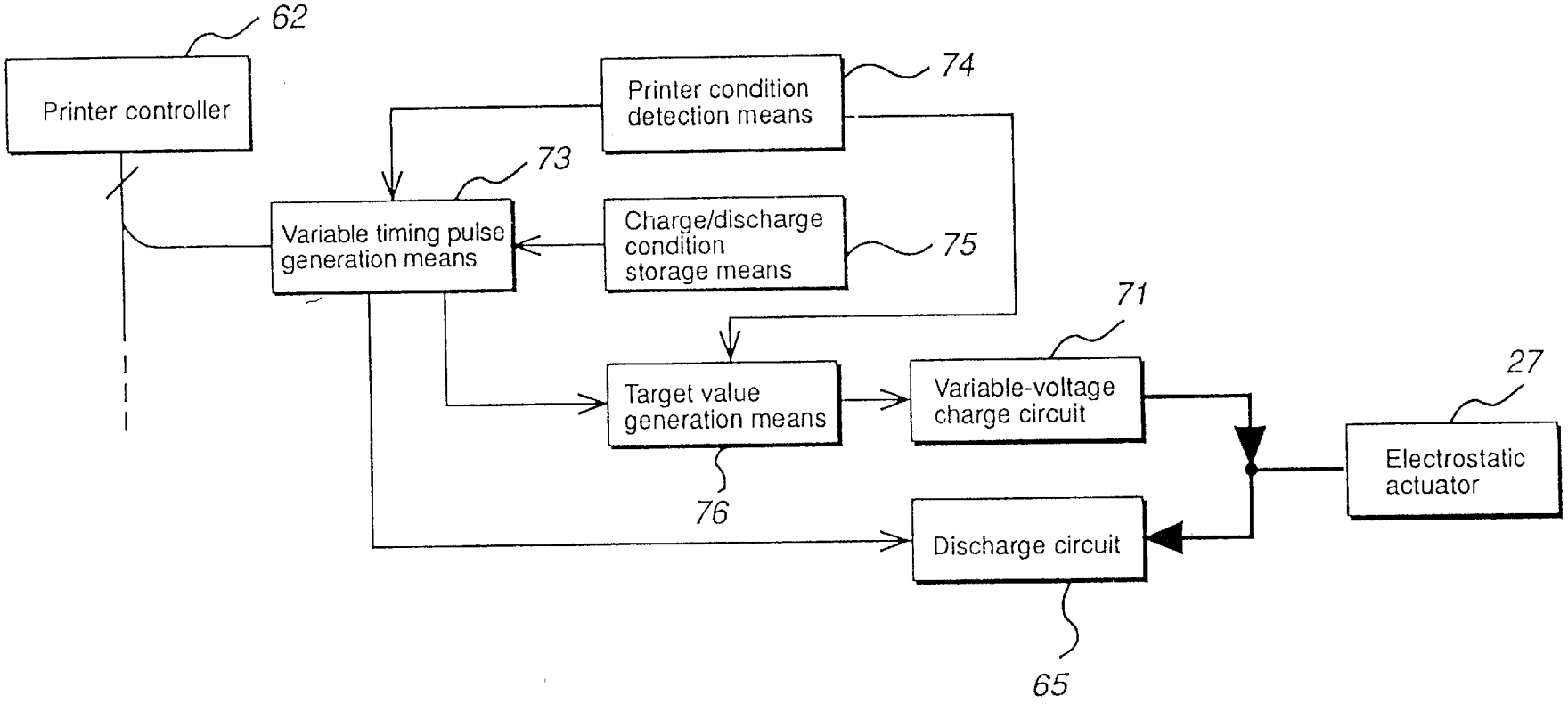
FIG. 32 is a block diagram for the electrostatic actuator driving circuit in accordance with an ninth embodiment of the present invention.

In view of these issues, as shown in FIG. 32, the ninth embodiment incorporates printer condition detection means 74, variable-timing pulse generation means 73, and charge condition storage means 75, in addition to the configuration used in the eighth embodiment. Additionally, the ninth embodiment replaces the target value generation means with a variable target value generation means 76 capable of changing the target value according to the condition of the printer. In this manner, variation in the viscosity of the ink can be dealt with flexibly, a variation that cannot be provided for by simply changing the charge time.

As an example of a variable target value generation means 26, FIG. 29 shows an example of a variable target value generation means using a computer or processor system. During the initialization of table addresses, at ST21, valuable target value generation means 76 reads status data from the printer condition detection means and selects the corresponding target value table from predetermined target value tables. After that, the target value generation means performs the same processing as that shown in the flowchart in FIG. 29. Specific examples of the detection of printer conditions include, in addition to those shown in FIG. 23, a means that places a public-domain temperature detector, such as a thermister, in the vicinity of the ink jet head, digitizes the resulting output voltage by means of an A/D converter, and inputs the digital data to the microprocessor.

The printer condition detection also includes the detection of printer setting conditions. In the case the ink jet heads and the drivers, which are the same in specification, are used for printers of different specification, the ink jet head drivers can select the drive condition by detecting the printer specification, e.g., the power supply voltage, print density, recording media type and so on, from the setting status of, for example, DIP switch mounted on the printer.

As the foregoing indicates, the present invention was accomplished in order to solve the problem to be solved for applying electrostatic actuators to practical ink jet printer heads. This led to the realization of a practical ink jet head driver for an electrostatic actuator and the application of this driver to an ink jet printer.

According to this invention as described above, when the ink jet head using an electrostatic force is driven for ink ejection, at the end of the electrode-diaphragm charging process, the diaphragm bends to the maximum extent and comes into proximity with the electrode. When the diaphragm is in this condition, the gap remains constant, and the gap between the electrode and the diaphragm is maintained at a short distance while not causing any contact between the electrode and the diaphragm. The result is reduced variation in ink ejection and speed and improved print quality. This solves the problems specific to the ink jet heads using the electrostatic force: contact between the diaphragm and the electrode and head destruction. This improves both the durability and the reliability of the head and reduces the drive voltage.

Further, according to the ink jet head drive method of the present invention as described above, a charge circuit that charges up the electrode and the diaphragm is connected to the electrode and the diaphragm, thus causing the diaphragm to be attracted to the electrode so as to cause ink suctioning. The charge circuit is disconnected when the bent diaphragm, which does not touch the electrode, is at a position that permits the suctioning of the ink necessary for adequate ink ejection. This stops the ink suctioning process. This condition is held for a specified length of time until the vibrations of the ink system reach a maximum. Then, a discharge circuit that releases the electrical charge stored in the electrode and the diaphragm is connected to either the electrode or the diaphragm, thus causing both to suddenly release the electrical charge stored in the area between the electrode and the diaphragm and to eject ink droplets. This drive method prevents any contact between the diaphragm and the electrode and a consequent shorting and head destruction. Also, this drive method ensures efficient utilization of the vibration energy due to the vibrations of the ink system and thus permits low-voltage drive.

Further, according to the ink jet head drive method of the present invention as described above, the charge pulses between the electrode and the diaphragm are allowed to rise within a prescribed range of slopes. This prevents the generation of bubbles in the ink channel and a consequent failure of ink ejection. Also, this method ensures an amount of ink suction sufficient to permit adequate ink ejection and thus produces a sufficient response speed to improve the printer operating speed without sacrificing the print quality.

In addition, the discharge state is maintained during the period from discharge to beginning of succeeding charge, thus preventing an electrostatic actuator from operating improperly under the influence of external noise and induction noise while inactive state of the electrostatic actuator.

It is further contemplated that the discharge signal and hold signal can be similarly varied or adjusted to the charge signal to achieve high quality outputs.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

REFERENCE NUMBERS

1. Substrate 1
2. Substrate 2
3. Substrate 3
4. Nozzle hole
5. Diaphragm
5*a* Oxide film
6. Ink ejection chamber
9. Vibration chamber
10. Ink jet head
21. Individual electrode
24. Insulator
27. Electrostatic actuator
40. Electrostatic actuator driver
41. Inverter
42. Transistor
43. Charge resistor
44. Buffer
45. Transistor
46 Discharge resistor
47. Discharge resistor
51. Charge signal
52. Discharge signal
53. Electrode-diaphragm voltage (Va)
61. Print-request section
62. Printer controller
63. Timing pulse generation means
64. Charge circuit
65. Discharge circuit
66. Voltage detection circuit
67. Comparison circuit
68. Current integration circuit
69. Comparison circuit
70. Target value generation means
71. Variable-voltage charge circuit
72. Variable-current charge circuit
73. Variable timing pulse generation means

74. Printer condition detection means
75. Charge/discharge condition storage means
76. Variable target value generation means
81, 82, 83. Mono-stable multivibrator
84, 86, 90, 95, 96, 97, 98. Op-amp
85. Comparator
87. Current detection resistor
88. Current integration capacitor
89. Discharge transistor
91. Counter
92. Memory
93. D/A converter
94. Transmitter
99. A/D converter
102. Meniscus
103. Ink
104. Ink droplets
105. Recording paper
302. Carriage
310. Carriage drive means

What is claimed is:

1. A method for recording on a sheet comprising the steps of:

providing a marking fluid jet head having a nozzle, a pathway in communication with the nozzle, and an actuator comprising a diaphragm provided at one part of the pathway, a first electrode provided in opposition to the diaphragm and a second electrode provided on a portion of the diaphragm, the first and second electrodes forming a capacitor;

applying a driving voltage signal with a first circuit to the first and second electrodes to electrostatically attract the diaphragm towards the first electrode in a first direction to fill the pathway with marking fluid; and electrically coupling with a second circuit the first electrode to the second electrode causing the diaphragm to move in the opposite direction away from the first electrode to thereby eject the marking fluid from the nozzle.

2. The method of claim 1, wherein the pathway and the diaphragm are formed in a semiconductor.

3. The method of claim 2, wherein the semiconductor is a p-type semiconductor and the driving voltage signal is positive.

4. The method of claim 2, wherein the semiconductor is an n-type semiconductor and the driving voltage signal is negative.

5. The method of claim 1, further comprising the steps of:

providing a waiting period after applying the driving voltage signal and before electrically coupling the first electrode to the second electrode.

6. The method of claim 1, wherein the second circuit comprises a resistance.

7. The method of claim 1, further comprising the steps of:

detecting a charge accumulated across the first and second electrodes; and controlling the application of the driving voltage signal in accordance with the detected accumulated charge.

8. The method of claim 1, further comprising the steps of:

detecting a pressure of the marking fluid in the pathway; and controlling the application of the driving voltage signal in accordance with the detected pressure.

9. The method of claim 1, further comprising the steps of:

detecting a displacement of the diaphragm; and controlling the application of the driving voltage signal in accordance with the detected displacement.

10. The method of claim 1, further comprising the steps of:

detecting a voltage across the first and second electrodes; and controlling a duration of coupling the first electrode to the second electrode in accordance with the detected voltage.

11. The method of claim 1, further comprising the steps of:

detecting a charge accumulated across the first and second electrodes; and controlling a duration of coupling the first electrode to the second electrode in accordance with the detected accumulated charge.

12. The method of claim 1, further comprising the steps of:

applying a second driving voltage signal to the first electrode to the second electrode, causing the diaphragm to stabilize.

13. A method for recording on a sheet comprising the steps of:

providing a marking fluid jet head having a nozzle, a pathway in communication with the nozzle and a diaphragm provided at one part of the pathway;

forming a capacitor having a first electrode and a second electrode arranged on the diaphragm;

applying a charging voltage signal with a first circuit to the capacitor to cause the pathway to fill with marking fluid; and discharging the capacitor with a second circuit to thereby eject the marking fluid from the nozzle.

14. The method of claim 13, wherein the diaphragm is formed in a semiconductor substrate.

15. The method of claim 14, wherein the semiconductor is a p-type semiconductor and the charging voltage signal is positive.

16. The method of claim 14, wherein the semiconductor is a n-type semiconductor and the charging voltage signal is negative.

17. The method of claim 13, further comprising the steps of:

detecting a charge accumulated across the capacitor; and controlling a duration for discharging the capacitor in accordance with the detected accumulated charge.

18. The method of claim 13, further comprising the steps of:

detecting a pressure of the marking fluid in the pathway; and controlling a duration discharging the capacitor in accordance with the detected pressure.

19. The method of claim 13, further comprising the steps of:

detecting a displacement of the diaphragm; and controlling a duration for discharging the capacitor in accordance with the detected displacement.

20. The method of claim 13, further comprising the steps of:

providing a waiting period after applying the charging voltage signal and before discharging the capacitor.

21. The method of claim 13, further comprising the steps of:

detecting a voltage across the capacitor; and controlling the application of the charging voltage signal in accordance with the detected voltage.

22. The method of claim 13, further comprising the steps of:

detecting a charge accumulated across the capacitor; and controlling the application of the charging voltage signal in accordance with the detected accumulated charge.

23. The method of claim 13, further comprising the steps of:

detecting a pressure of the marking fluid in the pathway; and controlling the application of the charging voltage signal in accordance with the detected pressure.

24. The method of claim 13, further comprising the steps of:

detecting a displacement of the diaphragm; and controlling the application of the charging voltage signal in accordance with the detected displacement.

25. A method for recording on a sheet comprising the steps of:

(a) providing a marking fluid jet head having an array of nozzles, corresponding pathways in communication with respective ones of the nozzles and corresponding diaphragms provided at one part of each of the pathways;

(b) forming a plurality of capacitors, each corresponding to respective ones of the pathways, each one of the capacitors having a first electrode and a second electrode disposed on a corresponding diaphragm;

(c) selecting at least one of the nozzles for printing a pattern by:

applying a charging voltage signal with a first circuit to at least a selected one of the capacitors to fill a respective one of the pathways with marking fluid, and discharging the selected ones of the capacitors charged in the previous step with a second circuit to thereby eject marking fluid droplets from the selected nozzles; and (d) repeating step (c) to print successive patterns.

26. The method of claim 25, further comprising the steps of:

detecting a voltage across the selected capacitor; and controlling a duration for discharging the selected capacitor in accordance with the detected voltage.

27. The method of claim 25, further comprising the steps of:

detecting a charge accumulated across the selected capacitor; and controlling a duration for discharging the selected capacitor in accordance with the detected accumulated charge.

28. The method of claim 25, further comprising the steps of:

detecting a pressure of the marking fluid in the selected pathway; and controlling a duration for discharging the selected capacitor in accordance with the detected pressure.

29. The method of claim 25, further comprising the steps of:

detecting a displacement of the selected diaphragm; and controlling a duration for discharging the selected capacitor in accordance with the detected displacement.

30. The method of claim 25, wherein the pathways and the diaphragms are formed in a semiconductor substrate.

31. The method of claim 30, wherein the semiconductor is a p-type semiconductor and the charging voltage signal is positive.

32. The method of claim 30, wherein the semiconductor is an n-type semiconductor and the charging voltage signal is negative.

33. The method of claim 25, further comprising the step of providing a waiting period after applying the charging voltage signal and before discharging the capacitor.

34. The method of claim 25, further comprising the steps of:

detecting a voltage across the selected capacitor; and controlling the application of the charging voltage signal in accordance with the detected voltage.

35. The method of claim 25, further comprising the steps of:

detecting a charge accumulated across the selected capacitor; and controlling the application of the charging voltage signal in accordance with the detected accumulated charge.

36. The method of claim 25, further comprising the steps of:

detecting a pressure of the marking fluid in the selected pathway; and controlling the application of the charging voltage signal in accordance with the detected pressure.

37. The method of claim 25, further comprising the steps of:

detecting a displacement of the selected diaphragm; and controlling the application of the charging voltage signal in accordance with the detected displacement.

38. An ink jet printer provided with an ink jet print head comprising:

a nozzle;

an ink channel in communication with said nozzle;

an electrostatic actuator comprising a diaphragm which is provided in a part of said ink channel and an electrode arranged outside of said ink channel opposite to said diaphragm; and voltage application means having a first circuit for applying a drive voltage to said electrostatic actuator to attract said diaphragm towards said electrode, and a second circuit for electrically coupling said diaphragm to said electrode causing said diaphragm to move in an opposite direction away from said electrode to thereby eject ink droplets from the nozzle.

39. The printer of claim 38, further comprising a semiconductor substrate, wherein said ink channel and said diaphragm are formed in said semiconductor substrate.

40. The method of claim 39, wherein said semiconductor substrate is a p-type semiconductor and the drive voltage is positive.

41. The method of claim 39, wherein said semiconductor substrate is an n-type semiconductor and the drive voltage is negative.

42. An ink jet printer provided with an ink jet print head comprising:

a nozzle;

an ink channel in communication with said nozzle;

an electrostatic actuator comprising a diaphragm which is provided in a part of said ink channel and a capacitor having a first electrode arranged outside of said ink channel opposite to said diaphragm and a second electrode arranged on the diaphragm;

voltage application means having a first circuit for applying a charging voltage signal to said capacitor to cause said ink channel to fill with marking fluid, and a second circuit for discharging said capacitor to thereby eject said marking fluid from the nozzle.

43. The printer of claim 42, further comprising a semiconductor substrate, wherein said ink channel and said diaphragm are formed in a semiconductor substrate.

44. The printer of claim 43, wherein said semiconductor substrate is a p-type semiconductor and the charging voltage signal is positive.

45. The printer of claim 43, wherein said semiconductor substrate is a n-type semiconductor and the charging voltage signal is negative.

46. An ink jet printer provided with an ink jet print head comprising:

an array of nozzles corresponding pathways in communication with respective ones of said array of nozzles;

corresponding diaphragms provided at one part of each said pathways;

a plurality of capacitors, each corresponding to respective ones of said pathways, each one of the capacitors having a first electrode and a second electrode disposed on a corresponding diaphragm;

voltage application control means selecting at least one of said array of nozzles for printing a pattern, said voltage application control means comprising;

a first circuit applying a charging voltage signal to at least a selected one of said capacitors to fill a respective one of said pathways with marking fluid, and a second circuit discharging said selected ones of said capacitors charged in by said first circuit to thereby eject marking fluid droplets from said selected nozzles.

47. The printer of claim 46, further comprising a semiconductor substrate wherein said pathways and said diaphragms are formed in said semiconductor substrate.

48. The printer of claim 47, wherein said semiconductor substrate is a p-type semiconductor and the charging voltage signal is positive.

49. The printer of claim 47, wherein said semiconductor substrate is a n-type semiconductor and the charging voltage signal is negative.

* * * * *